US006643865B2

(12) United States Patent
Bork et al.

(10) Patent No.: US 6,643,865 B2
(45) Date of Patent: Nov. 11, 2003

(54) LAVATORY SYSTEM

(75) Inventors: Kevin W. Bork, West Allis, WI (US); Timothy E. Perrin, Hartford, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 131 days.

(21) Appl. No.: 09/775,191

(22) Filed: Feb. 1, 2001

(65) Prior Publication Data

US 2002/0100112 A1 Aug. 1, 2002

(51) Int. Cl.[7] ..... A47K 4/00
(52) U.S. Cl. ..... 4/664; 4/254
(58) Field of Search ..... 4/664, 663, 234, 4/237, 242, 254, 252, 465, 469; D23/270, 271, 273, 274

(56) References Cited

U.S. PATENT DOCUMENTS

| | | | | | |
|---|---|---|---|---|---|
| 37,896 | A | | 3/1863 | Bissicks | |
| 68,802 | A | | 9/1867 | Staples | |
| 127,540 | A | * | 6/1872 | Young | 4/469 |
| 135,817 | A | * | 2/1873 | Kent | 4/469 |
| 200,480 | A | | 2/1878 | Rivera | |
| 316,324 | A | * | 4/1885 | Barnwell | 4/664 |
| 345,890 | A | | 7/1886 | Farson | |
| 426,287 | A | | 4/1890 | Larkin | |
| 882,760 | A | | 3/1908 | Hubert | |
| 968,541 | A | | 8/1910 | Connelly | |
| 1,180,140 | A | | 4/1916 | Godoy | |
| 1,225,914 | A | | 5/1917 | Wood | |
| 1,342,505 | A | * | 6/1920 | Kinch | 4/242.1 |
| 1,409,330 | A | | 3/1922 | Aper | |
| 1,763,209 | A | | 6/1930 | Ayers et al. | |
| 1,763,277 | A | | 6/1930 | Tilden | |
| 1,793,815 | A | | 2/1931 | McCann | |
| 1,841,143 | A | | 1/1932 | McCann | |
| D90,837 | S | | 10/1933 | Davison | |
| D97,839 | S | | 12/1935 | Callahan | |
| 2,184,722 | A | | 12/1939 | McLoughlin | 4/169 |
| 2,198,605 | A | | 4/1940 | Faber | 4/2 |
| 2,267,618 | A | | 12/1941 | Shapiro | 4/2 |
| D132,476 | S | | 5/1942 | Martin | |
| D144,811 | S | * | 5/1946 | Smith | D23/274 |
| 2,434,889 | A | | 1/1948 | Sacia | 4/235 |
| 2,443,214 | A | | 6/1948 | Williams | 4/10 |
| D162,619 | S | | 3/1951 | Blashfield | D4/5 |
| 2,558,443 | A | | 6/1951 | Krenov | 4/2 |
| 2,611,134 | A | | 9/1952 | Jarrett et al. | 4/10 |

(List continued on next page.)

FOREIGN PATENT DOCUMENTS

| | | |
|---|---|---|
| JP | 54-144028 | 11/1979 |
| JP | 0274931 | 11/1990 |

OTHER PUBLICATIONS

Versalette™Bedside Patient Care Units Model 4040 Series; Whitehall –a Division of Acorn Engineering (2 pages).

Hygeia Lav Standard Co., 709 Bethlehem Pike, Philadelphia, PA 19118; photocopy of marketing material of the *Module 100* (1 page).

*Primary Examiner*—Gregory Huson
*Assistant Examiner*—Huyen Le
(74) *Attorney, Agent, or Firm*—Foley & Lardner

(57) ABSTRACT

An apparatus for installation in a lavatory having a toilet with a bowl is disclosed. The apparatus comprises a base; a panel coupled to the base, a cover coupled to the panel and movable between a first position and a second position, a first mechanism including a linkage coupled to the panel and the cover. Access to the bowl of the toilet is at least partially obstructed by movement of the cover. A method of protecting a hinge mechanism for a lavatory system is also disclosed. The method comprises placing a barrier to extend across at least a portion of the hinge mechanism.

62 Claims, 25 Drawing Sheets

U.S. PATENT DOCUMENTS

| | | | | | |
|---|---|---|---|---|---|
| 2,750,599 | A | | 6/1956 | Colonna | 4/10 |
| 2,860,348 | A | | 11/1958 | McClenahan | 4/3 |
| 2,879,519 | A | * | 3/1959 | Mueller | 4/312 |
| 2,907,048 | A | | 10/1959 | Gould | 4/2 |
| D190,795 | S | | 7/1961 | Rancorn | D4/4 |
| D190,988 | S | | 8/1961 | Radcliff et al. | D4/4 |
| 2,994,887 | A | | 8/1961 | Thornton | 4/242 |
| 3,015,110 | A | | 1/1962 | Treand | 4/2 |
| 3,047,106 | A | | 7/1962 | Callahan | 189/1 |
| D197,944 | S | | 4/1964 | Tiller | D4/2 |
| D197,945 | S | | 4/1964 | Tiller et al. | D4/2 |
| D197,946 | S | | 4/1964 | Tiller | D4/2 |
| D197,947 | S | | 4/1964 | Tiller et al. | D4/4 |
| D198,256 | S | | 5/1964 | Tiller et al. | D4/4 |
| D199,048 | S | | 9/1964 | Tiller | D4/2 |
| 3,149,346 | A | | 9/1964 | Springer | 4/135 |
| D203,253 | S | | 12/1965 | de Kanter | D4/4 |
| D206,740 | S | | 1/1967 | Hoeffken | D81/19 |
| 3,419,911 | A | | 1/1969 | Wood | 4/10 |
| 3,436,764 | A | | 4/1969 | Colonna | 4/10 |
| 3,520,005 | A | | 7/1970 | Downes | 4/234 |
| 3,593,346 | A | | 7/1971 | Katona | 4/10 |
| 3,646,617 | A | | 3/1972 | Heald | 4/1 |
| 3,719,959 | A | | 3/1973 | Ekstrom | 4/168 |
| 3,780,383 | A | | 12/1973 | Katona | 4/10 |
| 3,829,906 | A | | 8/1974 | McPhee | 4/10 |
| D233,149 | S | | 10/1974 | Campbell | D23/49 |
| 3,881,200 | A | | 5/1975 | Maier-Gerber | 4/166 |
| 3,905,051 | A | | 9/1975 | Gozdziewski | 4/134 |
| 4,030,145 | A | | 6/1977 | Rowan | 4/10 |
| 4,045,827 | A | | 9/1977 | Morris et al. | 4/3 |
| 4,060,859 | A | | 12/1977 | Anderson | 4/102 |
| 4,089,073 | A | | 5/1978 | Campbell | 4/3 |
| D251,065 | S | | 2/1979 | Campbell | D23/49 |
| 4,138,748 | A | | 2/1979 | Zielinski | 4/312 |
| 4,142,255 | A | | 3/1979 | Togni | 4/1 |
| 4,142,256 | A | | 3/1979 | Campbell | 4/3 |
| D252,038 | S | | 6/1979 | Morris et al. | D23/49 |
| 4,177,527 | A | | 12/1979 | Uhlig | 4/3 |
| D256,153 | S | | 7/1980 | Juaire et al. | D23/48 |
| 4,221,441 | A | | 9/1980 | Bain | 312/228 |
| D266,268 | S | | 9/1982 | Adamcik | D23/69 |
| 4,366,584 | A | * | 1/1983 | Mchuma | 4/307 |
| 4,368,551 | A | | 1/1983 | Cummings | 4/661 |
| 4,396,240 | A | | 8/1983 | Henson | 312/237 |
| D281,714 | S | | 12/1985 | Morris et al. | D23/49 |
| 4,645,145 | A | | 2/1987 | Alie | 244/118.5 |
| D288,709 | S | | 3/1987 | Campbell | D23/49 |
| D288,710 | S | | 3/1987 | Campbell | D23/49 |
| 4,653,128 | A | | 3/1987 | Canalizo | 4/663 |
| 4,680,817 | A | | 7/1987 | Sloan et al. | 4/663 |
| 4,944,047 | A | | 7/1990 | Gagliano | 4/312 |
| 4,970,732 | A | | 11/1990 | Deng | 4/312 |
| D331,621 | S | | 12/1992 | Tapolcai | D23/214 |
| D352,096 | S | | 11/1994 | Tagg | D23/274 |
| D394,495 | S | | 5/1998 | Hauser, II | D23/284 |
| 5,765,237 | A | | 6/1998 | Okamoto et al. | 4/300 |
| 5,852,833 | A | | 12/1998 | Gregoire | 4/246.3 |
| 5,960,483 | A | | 10/1999 | Delzer et al. | 4/420 |
| D424,176 | S | | 5/2000 | Wheeler, III | D23/273 |
| 6,094,756 | A | | 8/2000 | Carter | 4/578.1 |
| 6,158,060 | A | | 12/2000 | Wheeler | 4/254 |

* cited by examiner

LAVATORY SYSTEM

FIELD OF THE INVENTION

The present invention relates to a lavatory system.

BACKGROUND

It is generally known to provide for a lavatory system for use in a home, commercial or institutional facility such as a medical care facility or the like. Known arrangements for lavatory systems may provide (in a compact design) a base (e.g. cabinet), a sink, water closet (i.e., with toilet), countertop, and may be configured with one or more accessories such as a bedpan washer, dialysis equipment, etc. Such lavatory systems may be configured to provide a movable toilet that can be moved from a use position to a stowed position, or to provide a movable cover for a stationary toilet that (relative to the base) can be deployed to "stow" the toilet (and provide a seat) or lifted to allow access to (or use of) the toilet. However, such known arrangements for lavatory systems may present inconvenient or disadvantageous features in application or use, such as relative difficulty to use (e.g., to stow or cover toilet), or to clean (or keep clean), or to maintain.

Accordingly, it would be advantageous to provide a lavatory system that has a compact design and a movable cover for the toilet. It would also be advantageous to provide a lavatory system with a mechanism for moving the cover relative to the base that is more convenient to use. It would further be advantageous to provide a lavatory system that is configured to be more convenient to clean, keep clean, and maintain. It would be desirable to provide for a lavatory system having one or more of these or other advantageous features.

SUMMARY

The present invention relates to an apparatus for installation in a lavatory having a toilet with a bowl. The apparatus comprises a base; a panel coupled to the base, a cover coupled to the panel and movable between a first position and a second position, a first mechanism including a linkage coupled to the panel and the cover. Access to the bowl of the toilet is at least partially obstructed by movement of the cover.

The present invention also relates to a lavatory system. The lavatory system comprises a base, a panel coupled to the base, a cover movable relative to the base between a first position and a second position, a mechanism coupled to the cover and the panel, the mechanism comprising at least one member having a first end and a second end, the first end being coupled to the panel and the second end being coupled to the cover. Movement of the cover from a use position towards a stowed position actuates the at least one member to move the panel from an extended position towards a retracted position.

The present invention further relates to a lavatory system. The lavatory system comprises a base, a cover coupled to the base, a panel hingedly coupled to the cover at an interface, and a barrier configured to extend at least partially across interface.

The present invention further relates to a method of protecting a hinge mechanism for a lavatory system. The method comprises placing a barrier to extend across at least a portion of the hinge mechanism.

DETAILED DESCRIPTION OF PREFERRED AND OTHER EXEMPLARY EMBODIMENTS

Figure 1:
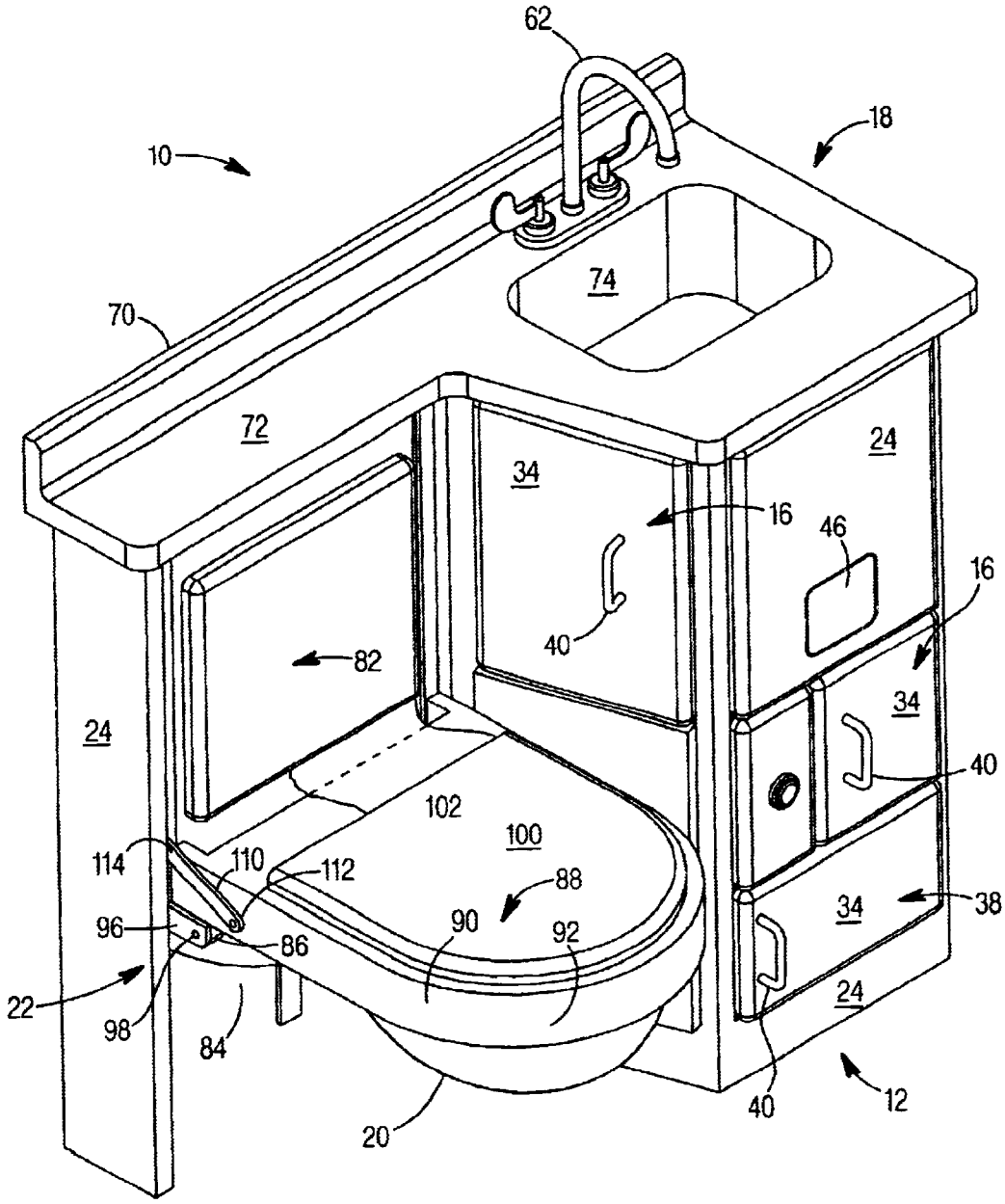
FIG. 1 is a perspective view of a lavatory system showing a toilet having a cover in a down or closed position according to a preferred embodiment.
Figure 2:
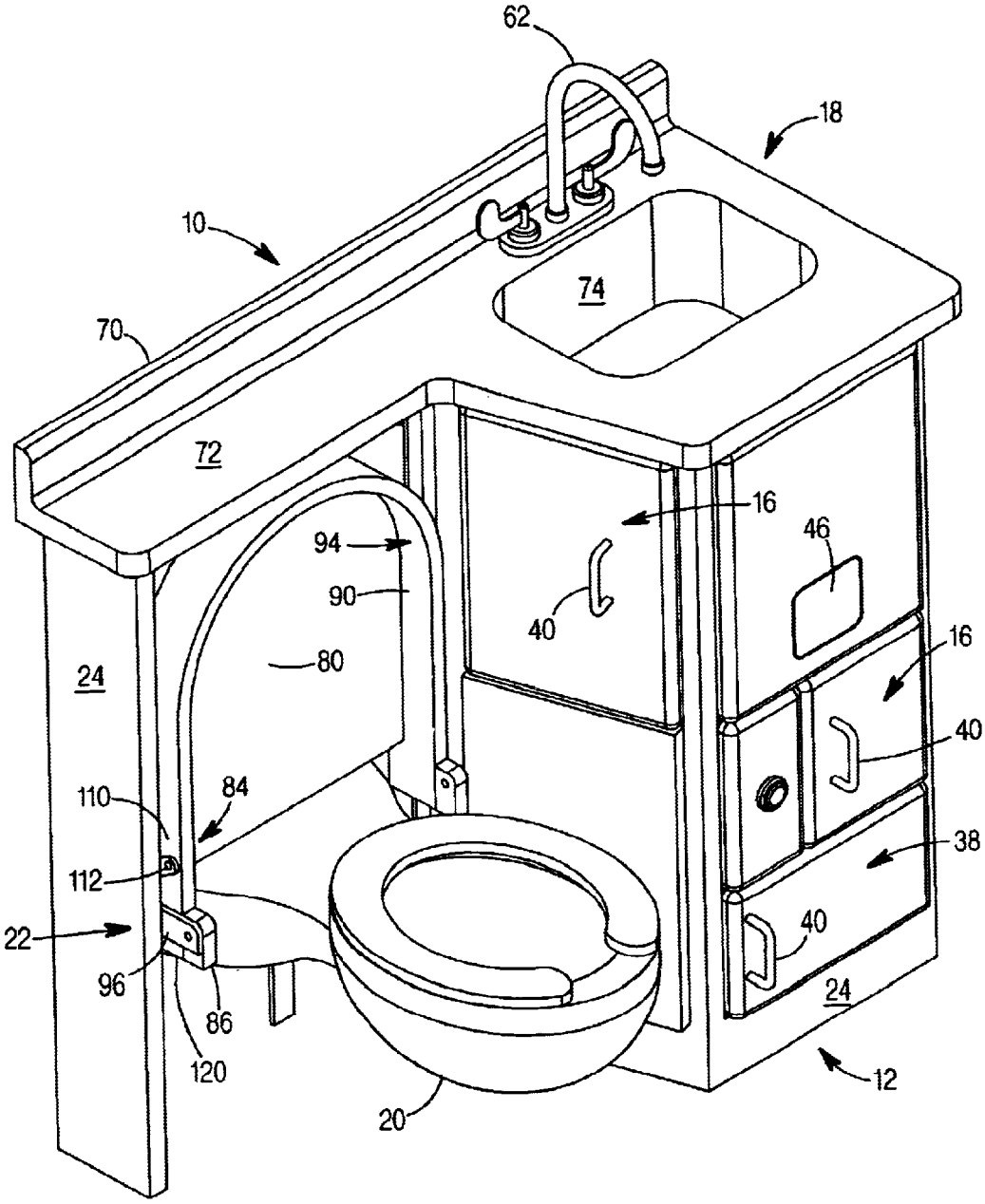
FIG. 2 is the perspective view of the lavatory system of FIG. 1 showing the cover in a up or open position exposing the toilet for use or access.
Figure 3:
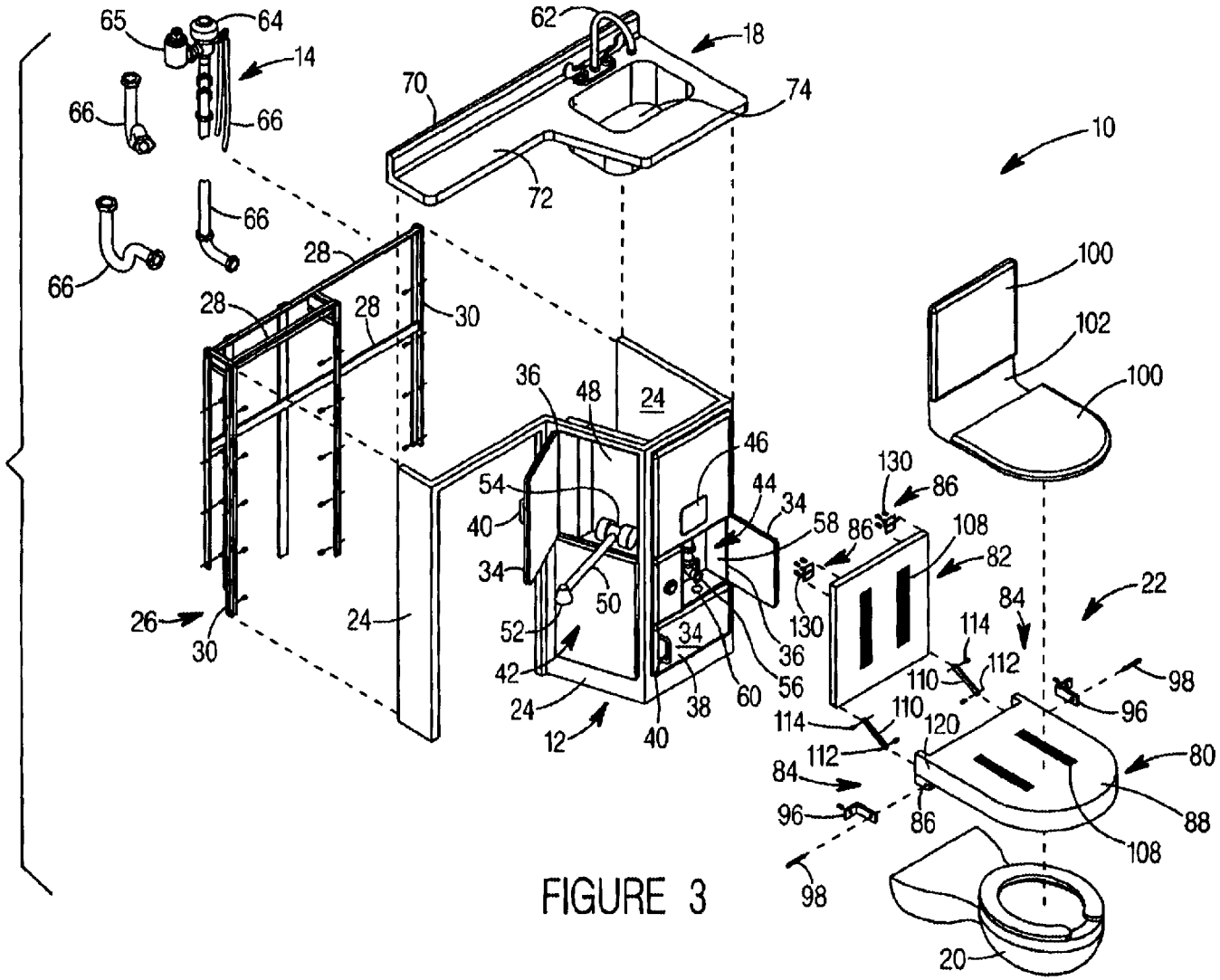
FIG. 3 is an exploded perspective view of the lavatory system of FIG. 1.
Figure 4:
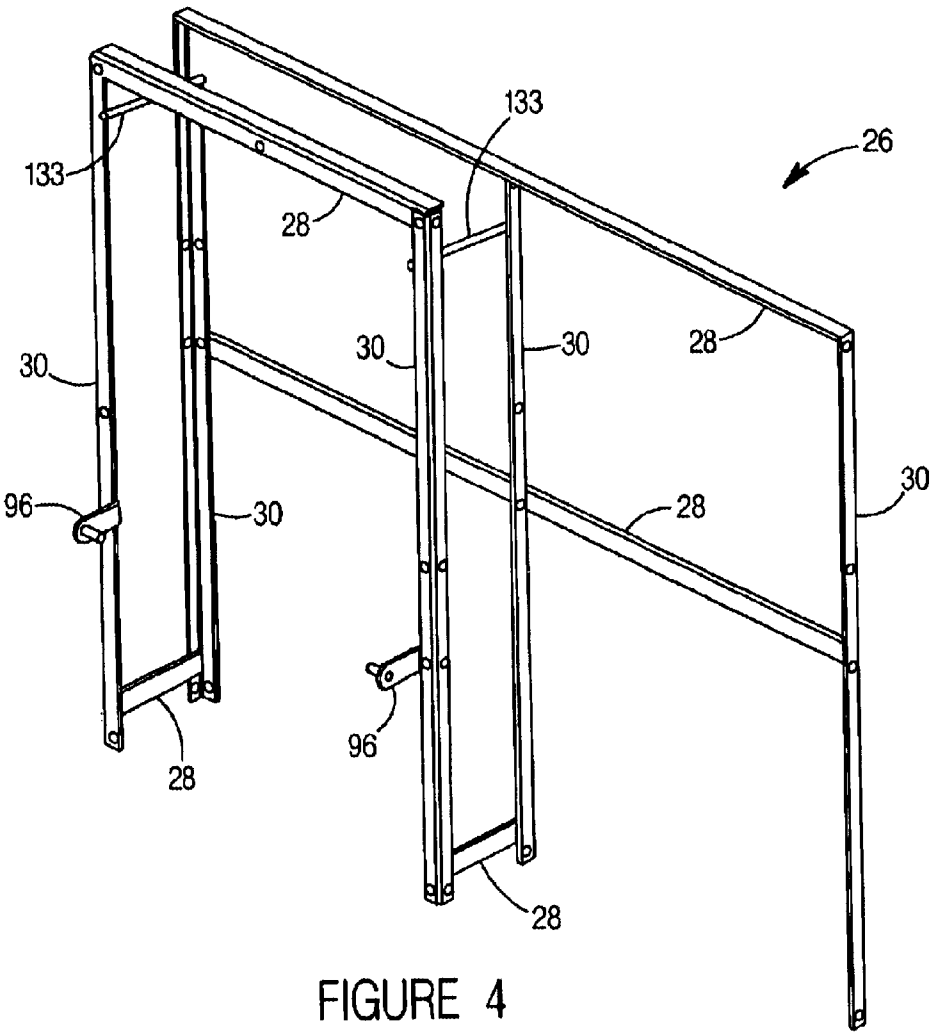
FIG. 4 is a perspective view of a frame for the lavatory system of FIG. 1.
Figure 5A:
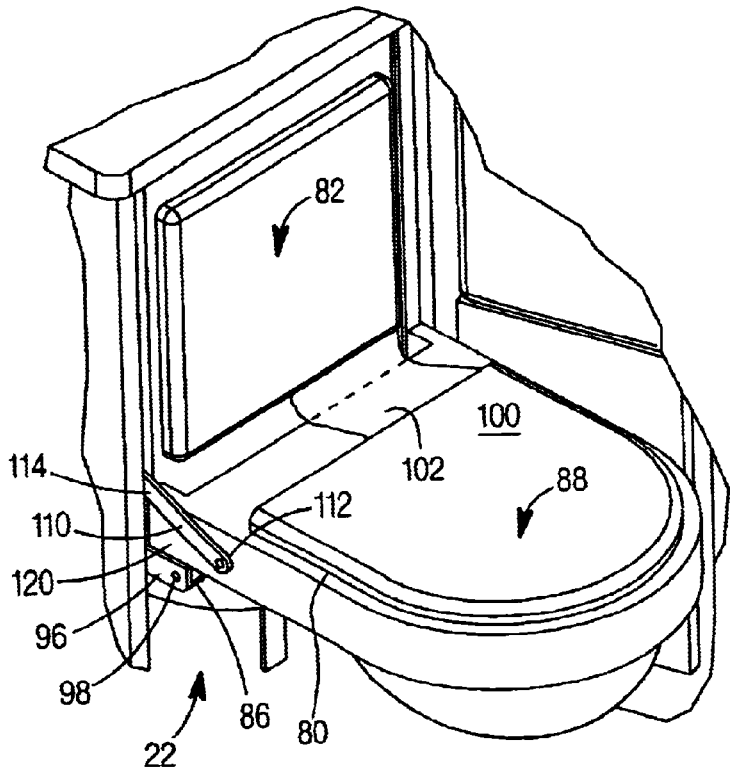
FIGS. 5A through 5C are front fragmentary perspective views of the lavatory system of FIG. 1.
Figure 5B:
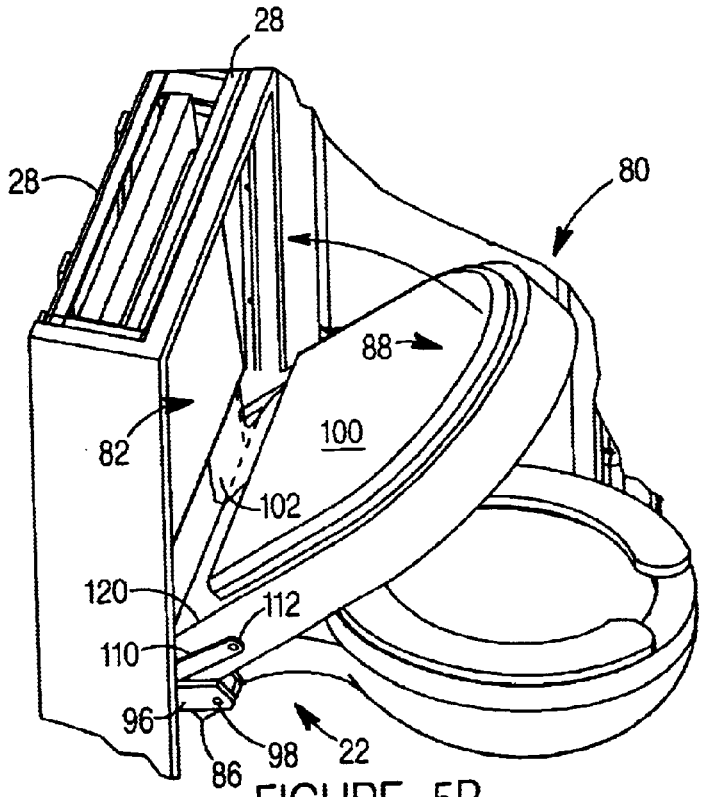
Figure 5C:
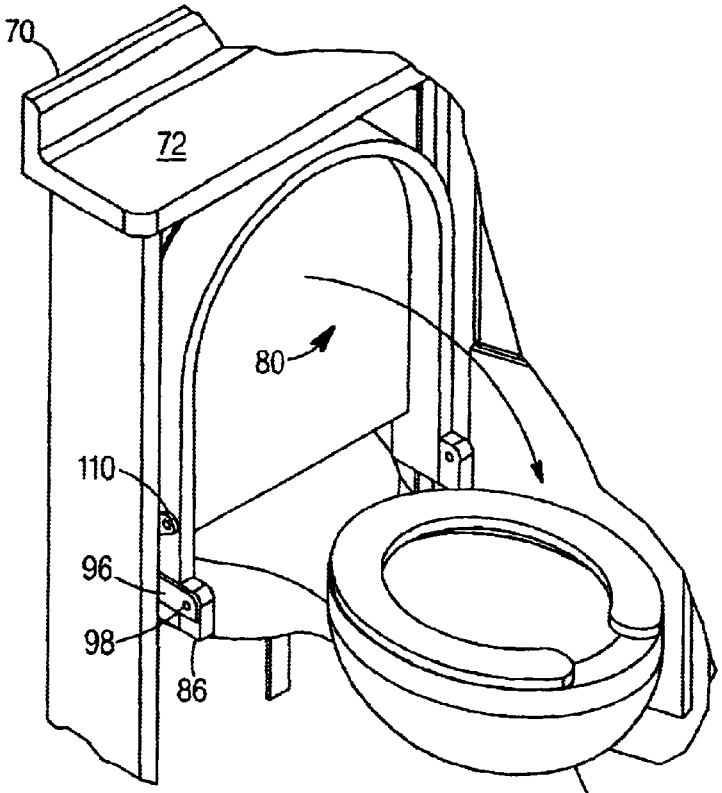

Referring to FIGS. 1–3, a lavatory system 10 is shown. Lavatory system 10 is shown to include base or a cabinet assembly 12, one or more accessories (shown as bedpan washer, dialysis equipment, etc.), a countertop 18 mounted on cabinet assembly 12, a receptacle (shown as a toilet 20) in third communication with a plumbing system 14, and a cover assembly 22.

Cabinet assembly 12 includes a structural frame 26. A plurality of panels 24 are mounted on frame 26. The panels may be attached to frame with a variety of techniques (e.g., fasteners, adhesives, welds, pins, etc.) according to any preferred embodiment.

Referring to FIGS. 3 and A, frame 26 is configured to support cabinet assembly 12 and cover assembly 22. Frame 26 includes a plurality of support members (shown as horizontal braces or members 28 and vertical braces or members 30). The support members may be connected by any of a variety of fabrication methods such as fasteners, welding, riveting, etc. According to a preferred embodiment, the support members are made from stainless steel (which is intended to enhance resist to corrosion). According to an alternative embodiment, the lavatory system is fabricated without a frame such that the cabinet assembly is configured to support itself the same as all of the other components of the lavatory system.

Referring to FIGS. 1–3, cabinet assembly 12 also includes one or more doors 34 coupled to panels 24 or frame 26 by hinges 36. Doors 34 may be configured to provide access to accessories 16, to a storage area 38, to plumbing system 14, or the like. According to a preferred embodiment, hinges 36 are made from stainless steel and configured to retract into cabinet assembly 12 when operated (e.g., barrel-type, piano-type, etc.). Doors 34 may be operated using handles 40 may be mounted to, doors 34 or magnetic push-catches (not shown). Storage areas 38 may be open storage space (e.g., for bedpans, medical equipment, etc.), a drawer, shelving or the like.

According to a preferred embodiment, accessories 16 may include a bedpan washer 42, a dialysis system 44, a bathroom tissue dispenser 46, etc. Bedpan washer 42 is mounted to cabinet assembly 12 and includes a housing 48 enclosing a pivoting stem 50 with a spray head 52. To operate bedpan washer 42, spray head 52 is pivoted over toilet 20. Bedpan washer 42 includes a pivot valve 54 so that positioning of stem 50 of bedpan washer 42 in a generally horizontal opens valve 54 to supply water to spray head 52. According to an alternative embodiment, the stem may include a flexible hose for manual direction and manipulation of the spray head. An interface hook-ups 56 for dialysis system 44 is enclosed by a housing 58 that is mounted to cabinet assembly 12. A drain 60 may be provided with housing 58 to collect drippage, drainage, spillage, or the like. According to alternative embodiments, a wide variety of accessories may be used or associated with the lavatory system.

Figure 6:
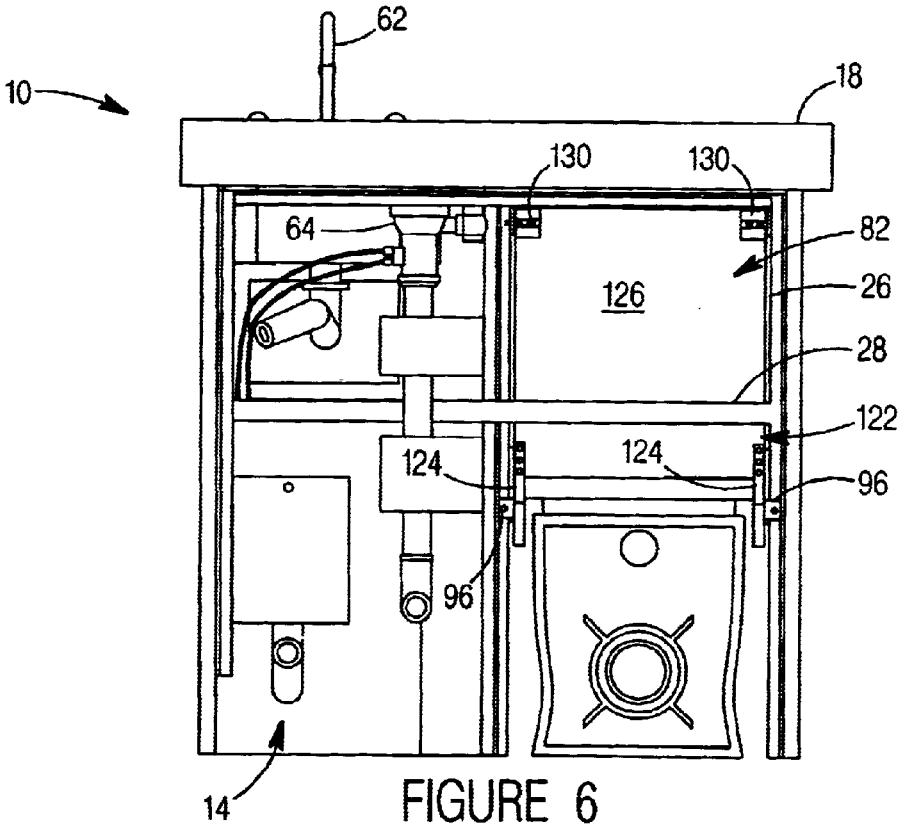
FIG. 6 is a rear perspective view of the lavatory system of FIG. 1.
Figure 7A:
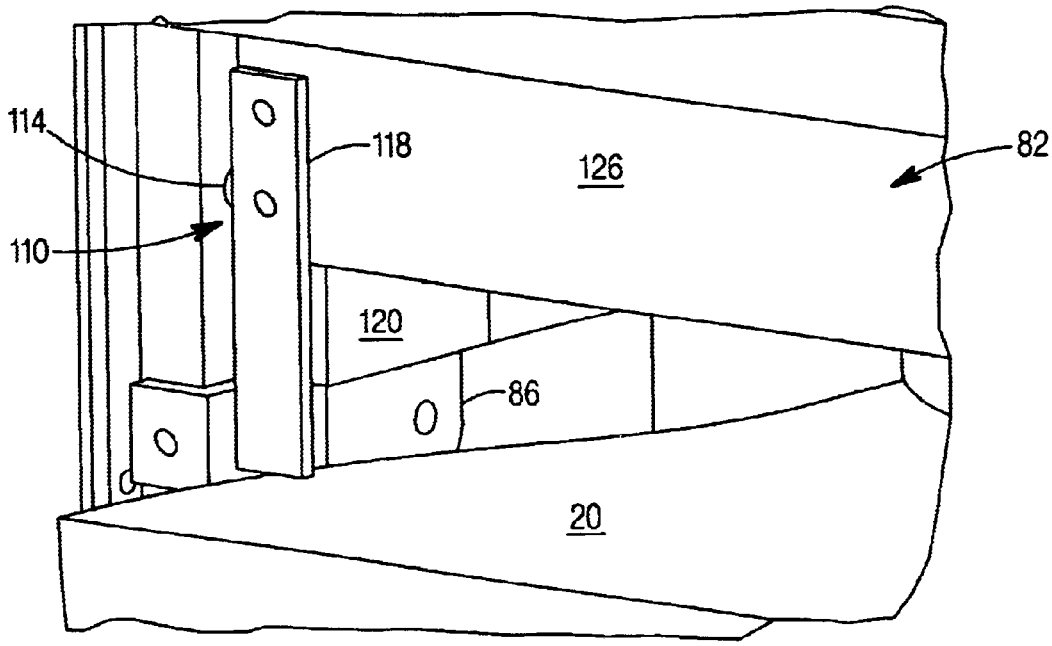
FIG. 7A is a rear fragmentary perspective view of the lavatory system of FIG. 1.

Referring to FIGS. 3 and 6, plumbing system 14 is generally enclosed by the cabinet assembly 12 and is in communication with toilet 20, a faucet assembly 62, and accessories (as appropriate, such as for bedpan washer 42, dialysis system 44, etc.). Plumbing system 14 is coupled to a water source and includes a flush valve 64, a check stop valve, and tubing, hoses, elbows, or other plumbing hardware 66. A valve interface (shown as a flush button 68) may be mounted to cabinet assembly 12 and configured to open and shut flush valve 64.

Referring to FIGS. 1–3, countertop 18 includes a back splash 70 and a deck 72. Deck 72 may include an aperture shaped to receive a basin 74 (e.g., top-mounted, under-mounted, etc.). According to a preferred embodiment, deck 72 is made of plywood with a laminate (e.g., Formica™) and basin 74 is made from stainless steel. Faucet assembly 62 is mounted to countertop 18 and/or basin 74, and may be any of a variety of commercially available faucets. Foot pedal controls (not shown) may be provided to actuate faucet. Alternatively, the faucet assembly may be fitted with infrared plug-in or battery controls.

Cover 80 is coupled to a panel (shown as a backrest 82) by a mechanism 84 (a linkage or mechanism, a hinge or hinge assembly, etc.), and backrest 82 is coupled to base 12 by a mechanism 86 (e.g., a follower, or follower assembly, follower mechanism, guide mechanism or assembly, track mechanism or assembly, etc.) that couples backrest 82 to frame 26. The cover may be shaped and configured and otherwise adapted for any toilet.

According to a preferred embodiment, cover 80 is configured to be moved between two positions. The first (or "deployed") position is generally horizontal and is configured to provide a lid to cover the upper portion of toilet 20. The cover may also provide an upper surface 88 for convenience of use and maintenance, appearance, and to provide a surface for seating (e.g., a seat or seating surface) or for temporarily placing an object. The second (or "stowed") position is generally vertical and is configured to provide access (e.g., visual or physical) to toilet 20. Cover 80 includes an apron 90 having an outer surface 92 (which is generally exposed to sight) and an inner surface 94 (which faces toilet 20).

Cover 80 is coupled to frame 26 by brackets 96 and coupled to backrest 82 by mechanism 84. Brackets 96 include inwardly facing pins 98 that are configured to engage apertures (holes) in blocks 86 so that Cover 80 pivots about pins 98 when moved. Blocks 86 extends downwardly from ends 120 of apron 90 (when cover 80 is in the horizontal position). According to a preferred embodiment, the brackets are welded (e.g., TIG welded) to the frame. According to an alternative embodiment, brackets 96 are attached to frame 26 with fasteners (e.g., screws, bolts, nuts, etc.), or attached to the cabinet, and pins 98 are inserted.

Figure 9A:
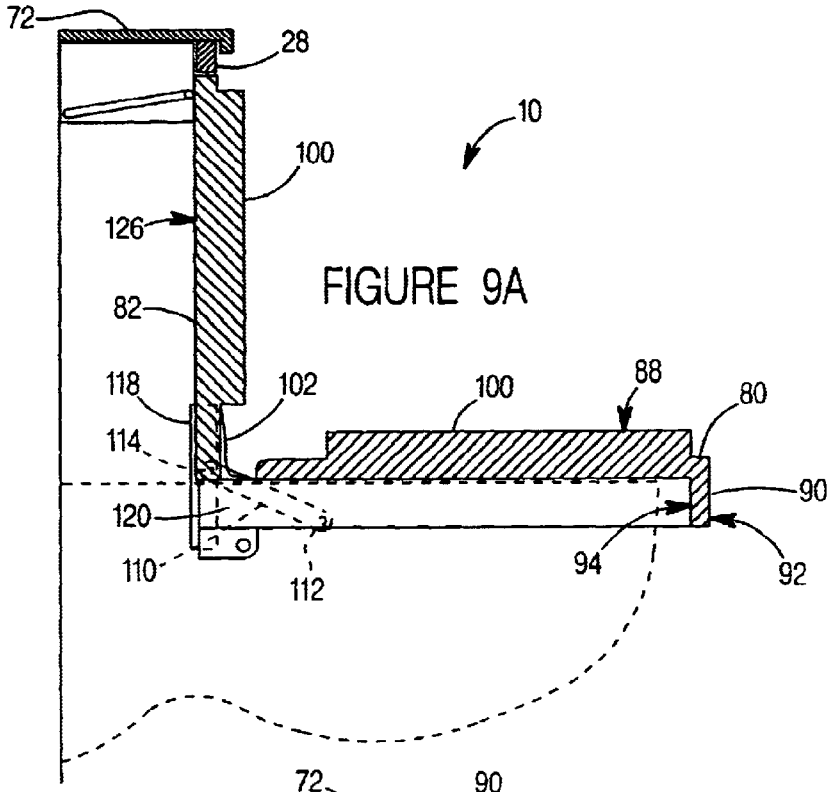
FIG. 9A is a sectional view of the lavatory system of FIG. 1.
Figure 9B:
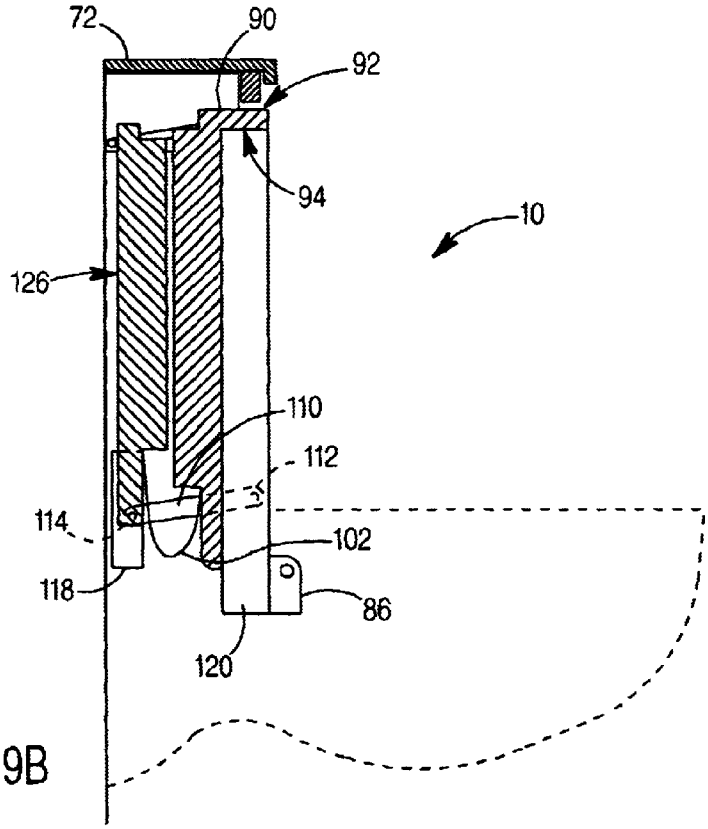
FIG. 9B is a sectional view of the lavatory system of FIG. 2.
Figure 10:
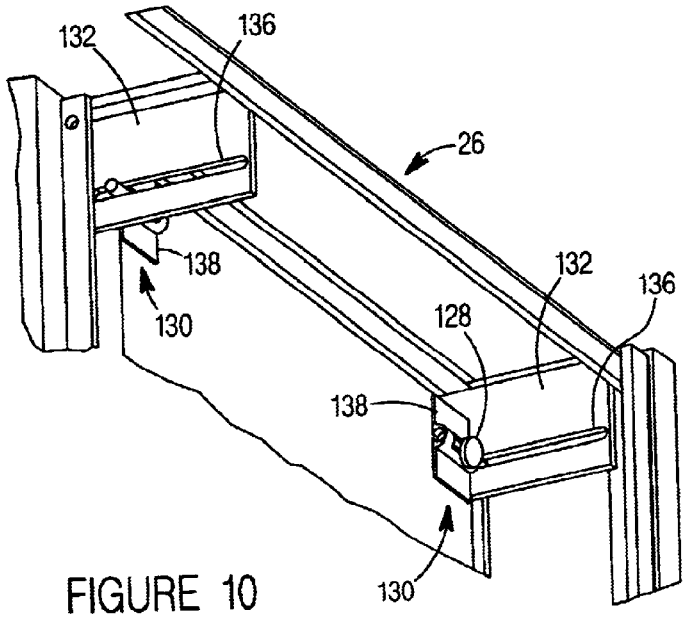
FIG. 10 is a fragmentary rear perspective view of the lavatory system of FIG. 2 with the cover in the open position.
Figure 11:
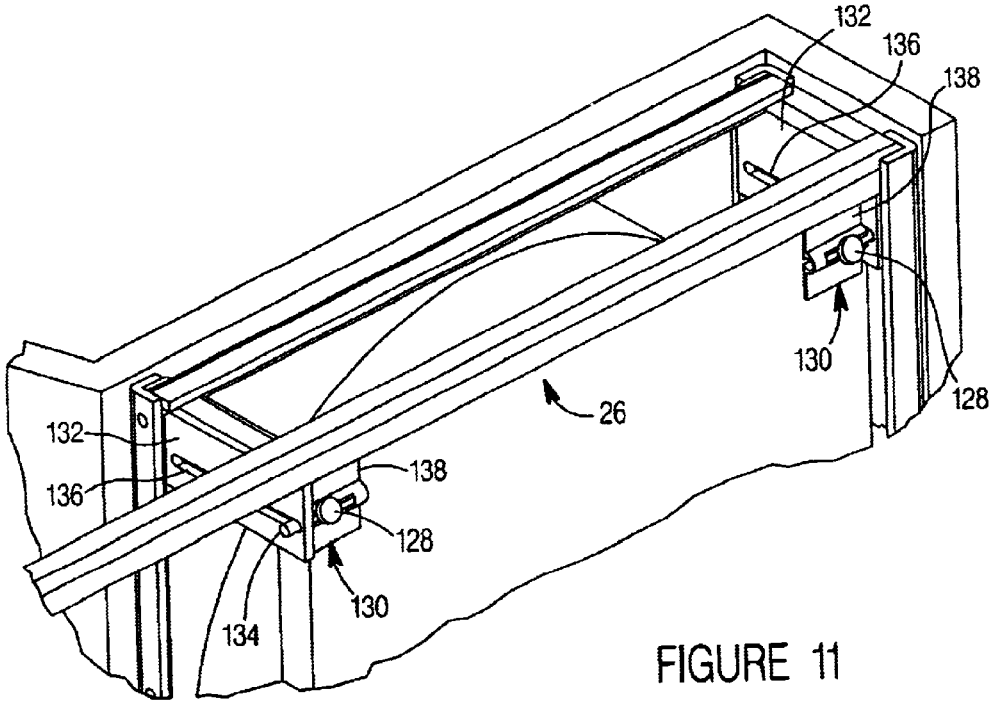
FIG. 11 is a fragmentary rear perspective view of the lavatory system of FIG. 2 with the cover in the open position.
Figure 12:
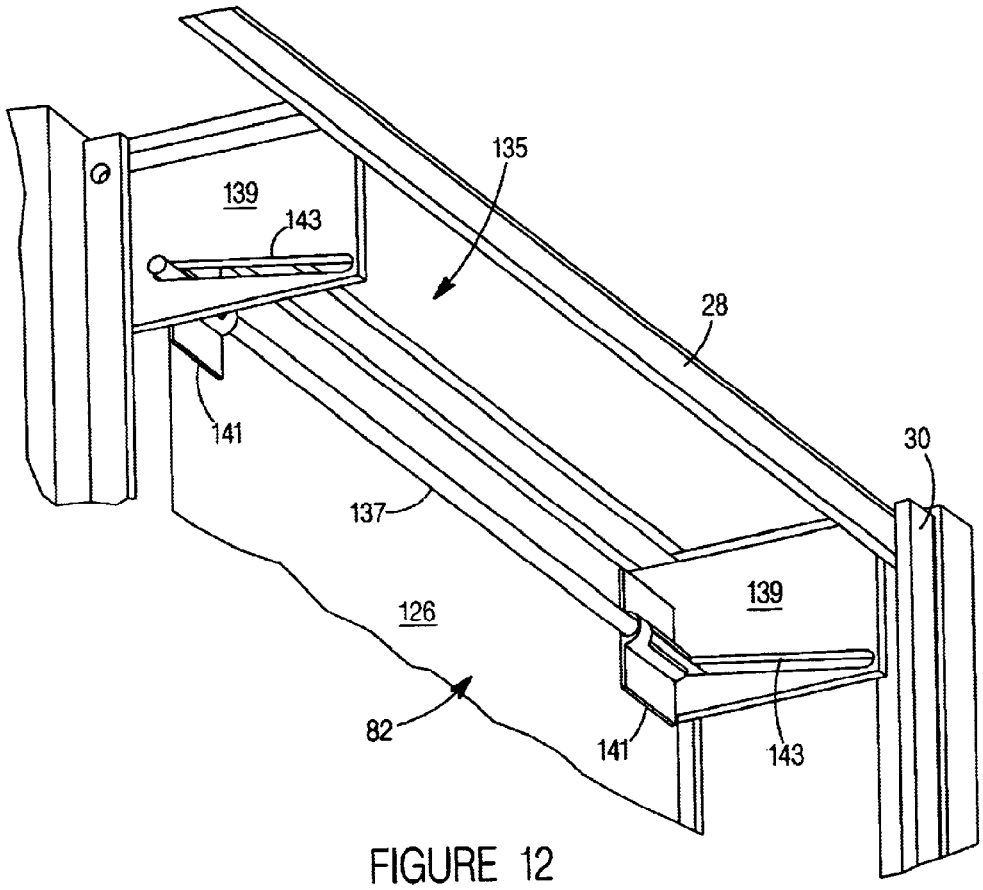
FIG. 12 is a perspective view of a lavatory system according to an alternative embodiment.

Backrest 82 is configured to prohibit access (e.g., visual and/or physical) to interior of cabinet 12. Backrest 82 may also be configured to provide structural support for the user to lean against when seated on cover 80. Backrest 82 is generally planar and is configured to be generally vertical when in the extended position (FIG. 9A) and in the retracted position (FIG. 9B).

Mechanism 86 includes a pair of members 110 (e.g., links, linkages, hinges, etc.) Members 110 are coupled at one end 112 to cover 80 and coupled at another end 114 to backrest 82. According to a preferred embodiment, edges of backrest 82 approximately align with edges of cover 80. As such, end 112 of member 110 couples to outer surface 92 of apron 90 away from end 120 of cover 80. Other end 114 of member 110 couples to an outer surface 122 of backrest 82.

During operation, as cover 80 is rotated, members 110 of mechanism 84 rotate about ends 112, 114 to move (e.g., pivot and/or translate) backrest 82 between the deployed and stowed positions. According to a particularly preferred embodiment, members are approximately 4.5 to 5.5 inches between pivot points, and is disposed at approximately a 24° to 30° angle (from horizontal). According to a particularly preferred embodiment, members are approximately 4.8 to 5.2 inches between pivot points, and is disposed at approximately a 25° to 29° angle (from horizontal). When cover 80 is in the generally vertical position, members 110 are configured to be in a generally horizontal position (see FIG. 9B). According to alternative embodiments, the mechanism may include a plurality of members (e.g., multiple linkage)

configured to move the backrest to the stowed position and/or to prohibit pivoting of backrest 82 past a desired position (e.g., generally vertical) when being leaned against by the user.

Backrest 82 is coupled to cover 80 by mechanism 84 and to frame 26 by follower assemblies 86. Mechanism 84 and follower assemblies 86 coact to pivot or rotate cover 80 from a generally horizontal position to a generally vertical position, and to move backrest 82 from a use position to a non-use (stowed) or retracted position.

According to a preferred embodiment shown in FIGS. 7A, 7B, 8A, 8B, 9A, and 9B, a bracket 118 (e.g., a right angled plate or bracket, etc.) is mounted to a lower end of backrest 82. Bracket 118 is configured to couple mechanism 84 to backrest 82, and is intended to provide a rigid structural reinforcement so that backrest 82 does not move relative to cover 80 when a user rests against it. Bracket 118 has two portions approximately 90° from each other. A first portion is coupled to the edge of backrest 82 and engages end 114 of member 110, and a second portion is coupled to back surface 126 of backrest 82. Second portion is configured to extend down from backrest 82 and interface with end 120 of cover 80. According to a particularly preferred embodiment, the bracket is made from rigid non-corrosive materials (e.g., stainless steel), but may be made from any of a variety metals and plastics.

According to an alternative embodiment shown in FIG. 6, a plate 124 is mounted to the lower end of backrest 82 and is configured to prohibit pivoting of backrest 82 past a desired position (e.g., generally vertical) when being leaned against by the user. Plate 124 generally planar and is mounted to back surface 126 of backrest 82 and interfaces with ends 120 of cover 80 (e.g., with fasteners or the like).

Figure 8A:
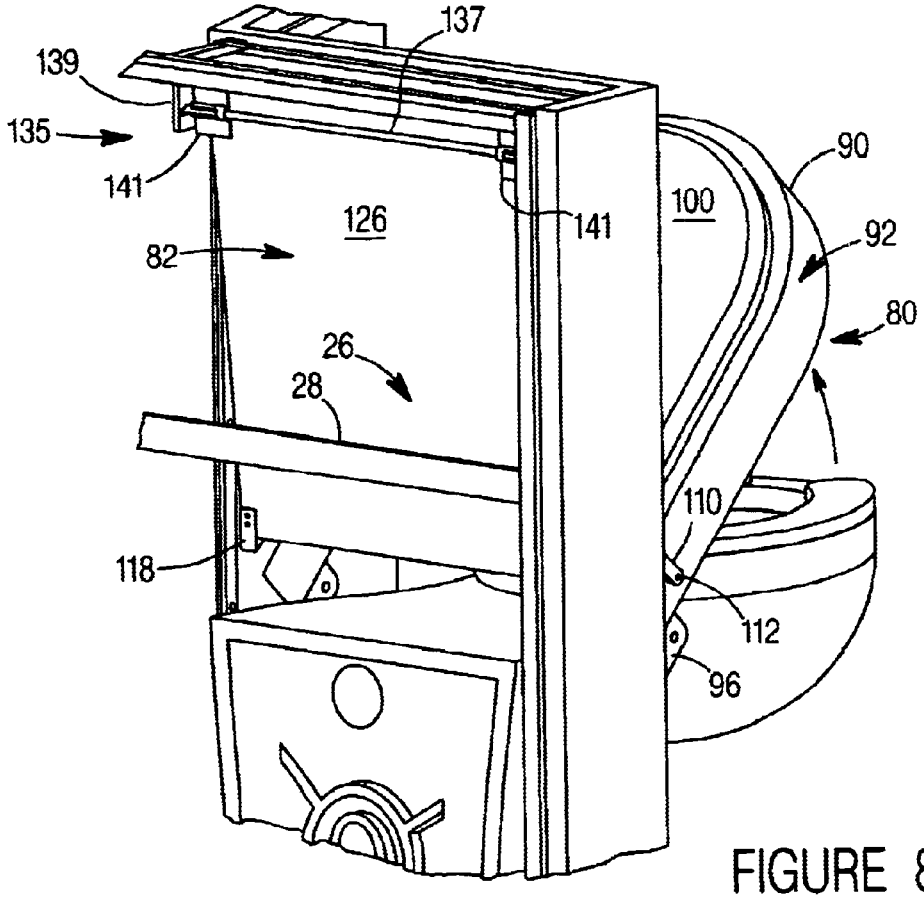
FIGS. 8A through 8B are fragmentary perspective views of the lavatory system of FIG. 1.
Figure 7B:
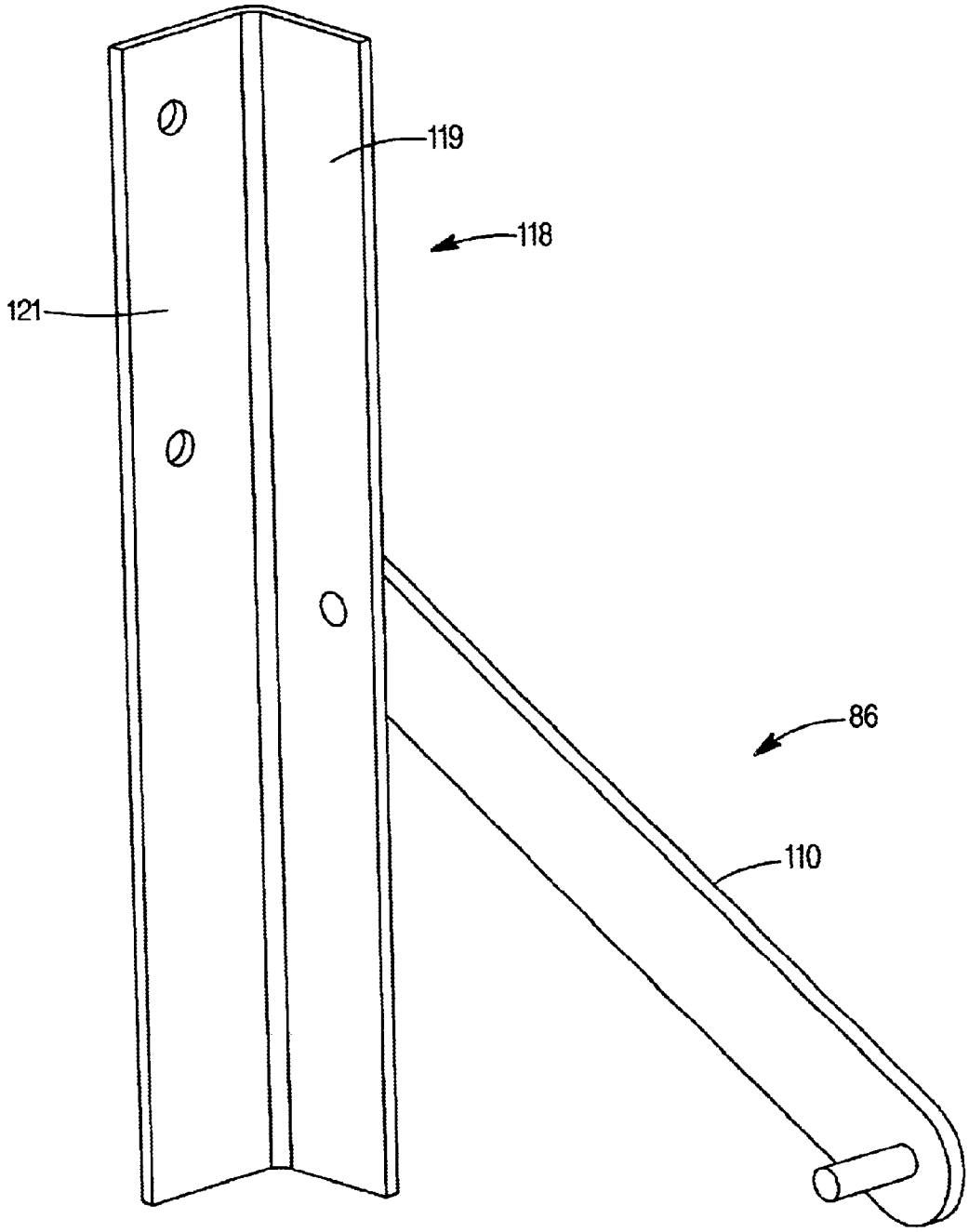
FIG. 7B is a front perspective view of a mechanism of the lavatory system of FIG. 1.
Figure 8B:
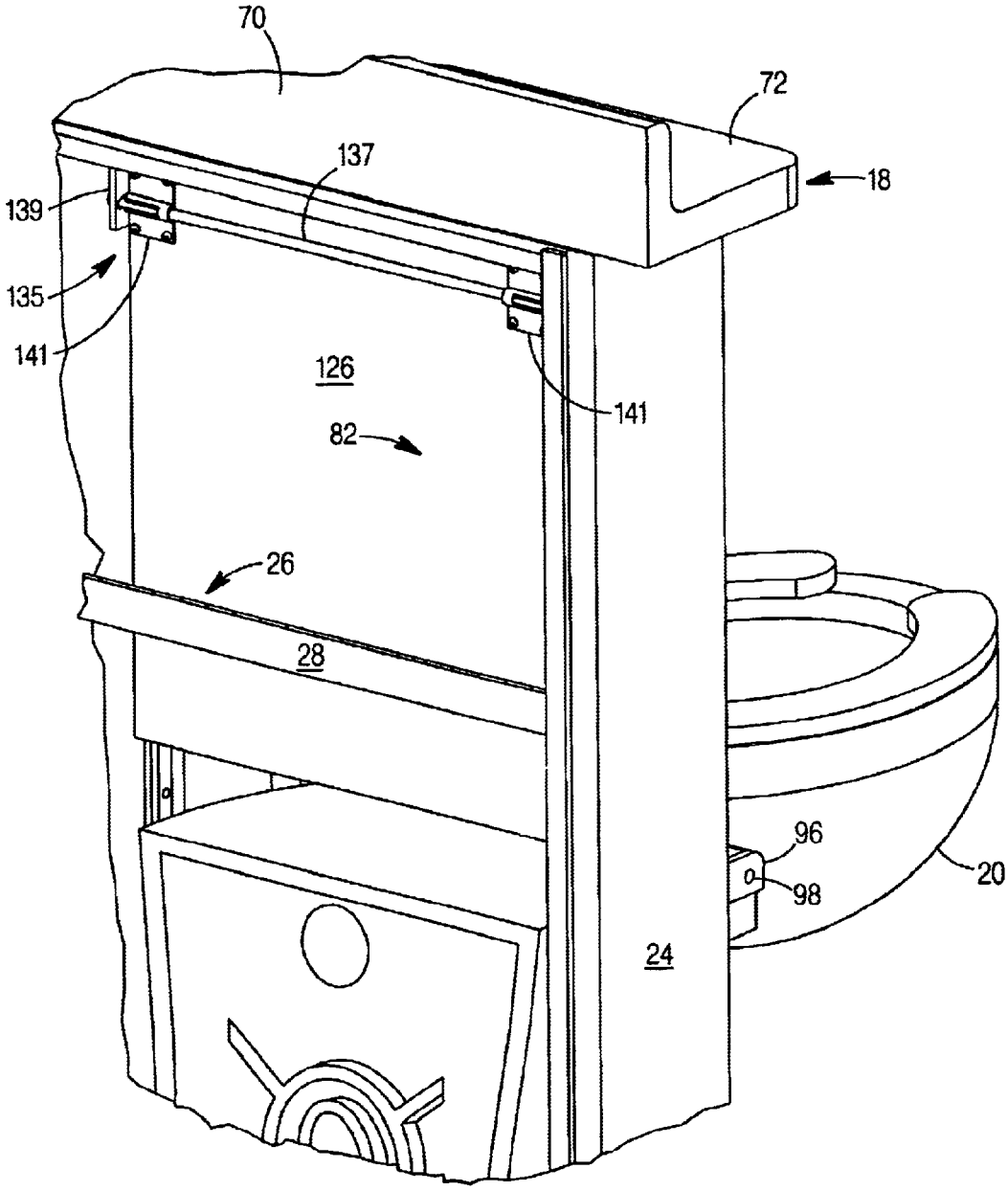
Figure 13:
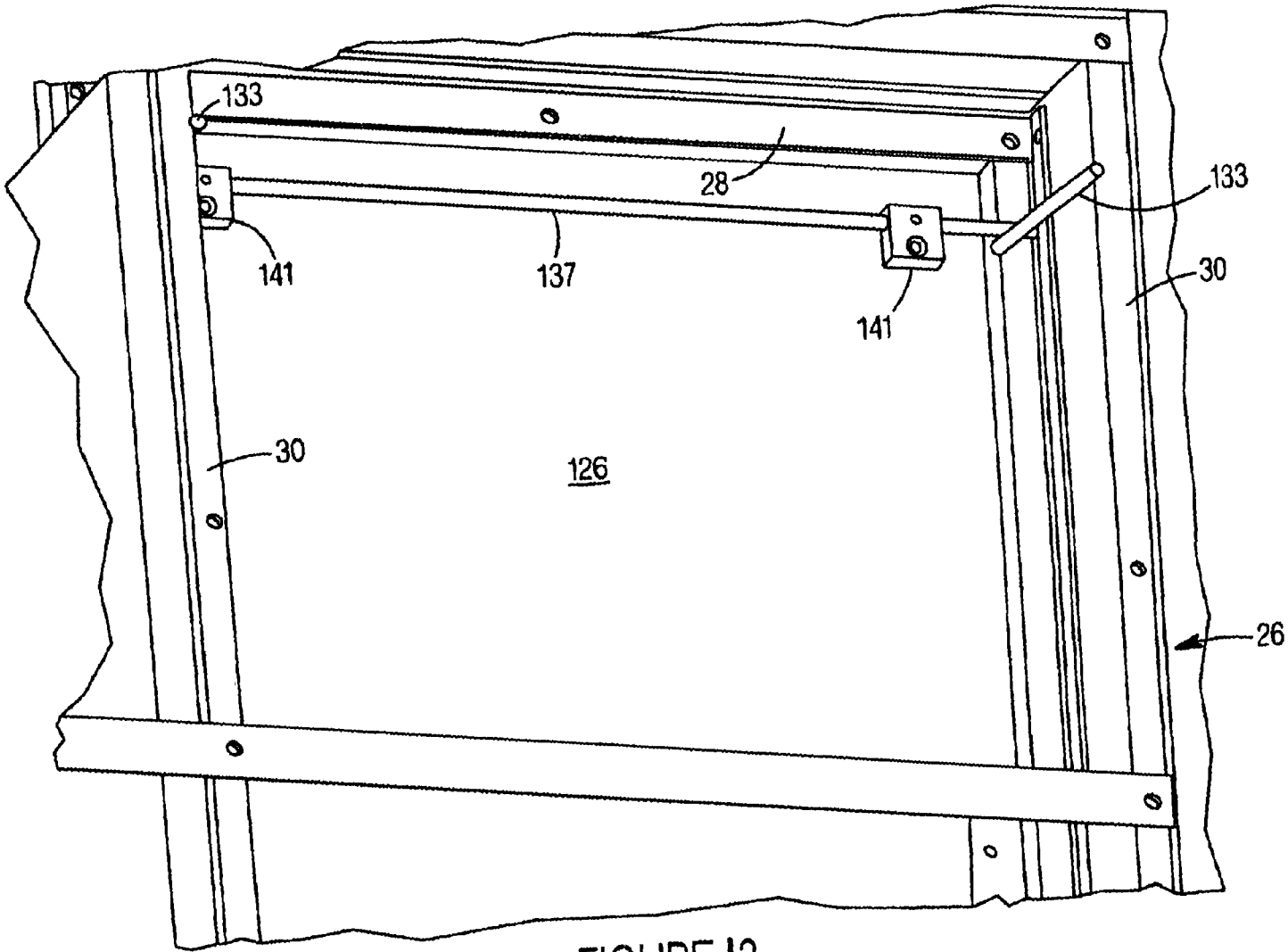
FIG. 13 is rear fragmentary perspective view of a lavatory system according to a preferred embodiment.
Figure 14:
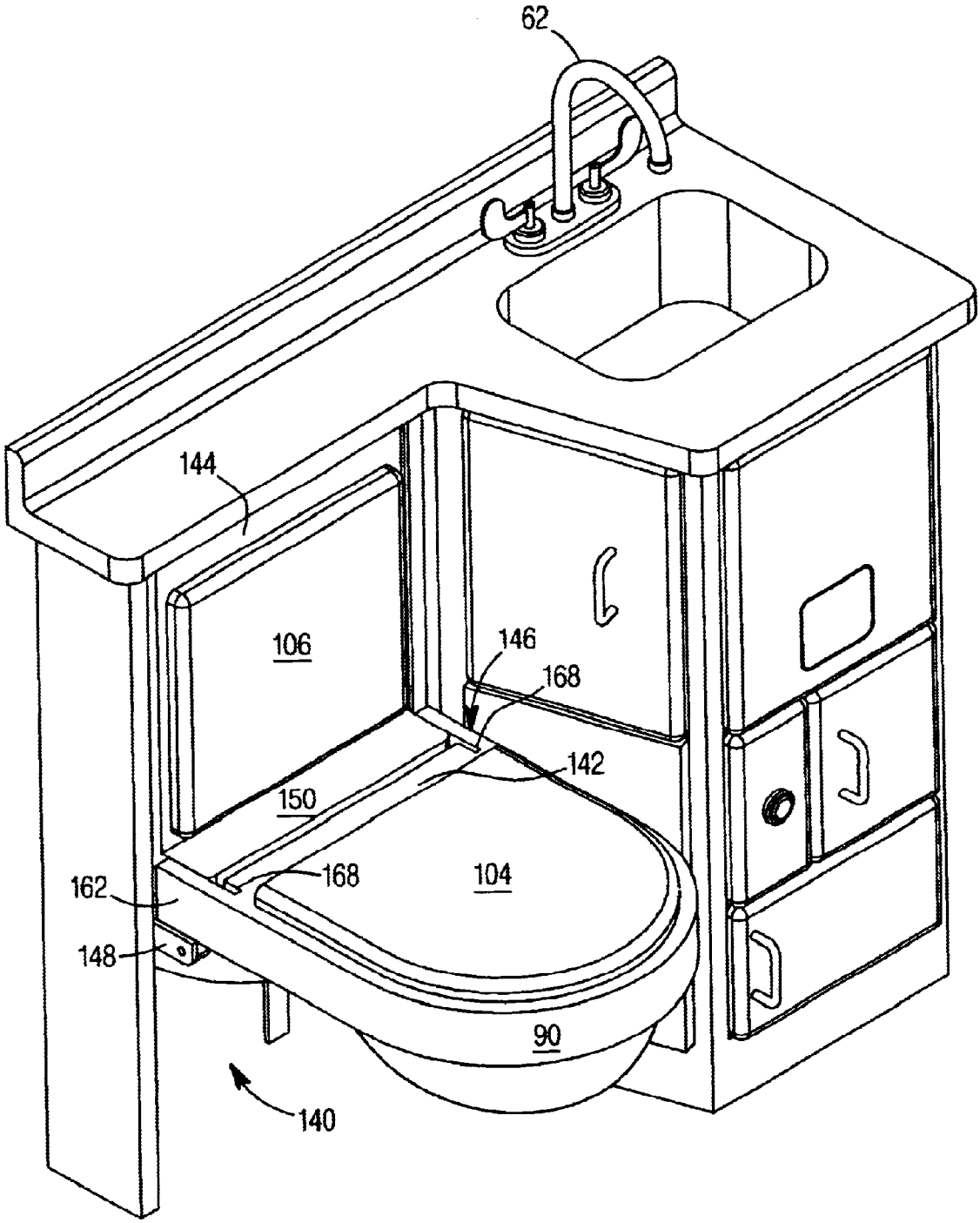
FIG. 14 is a cross-sectional view of the lavatory system of FIG. 12.
Figure 15:
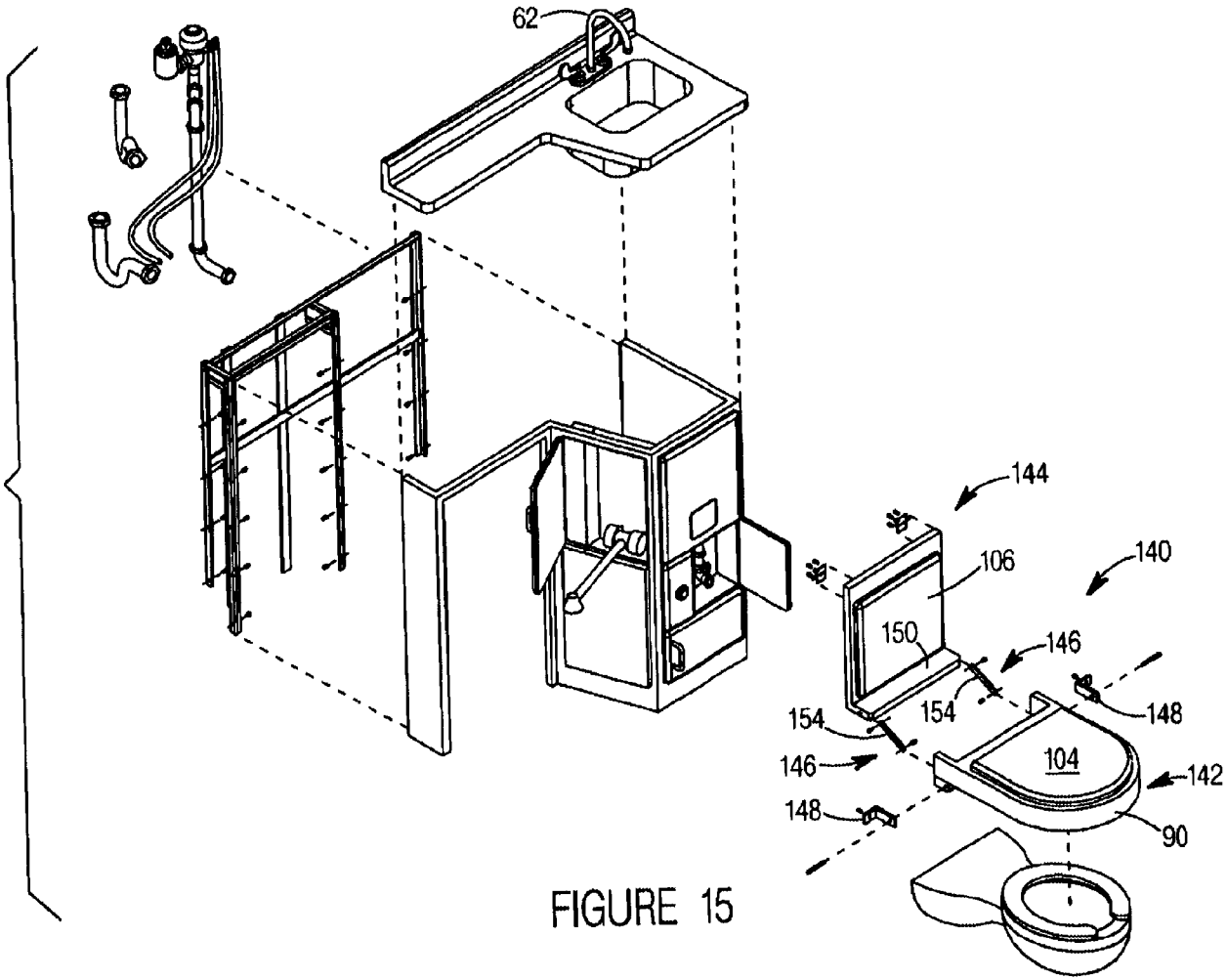
FIG. 15 is a perspective view of the lavatory system of FIG. 12 showing the toilet cover in the partially open position.
Figure 16A:
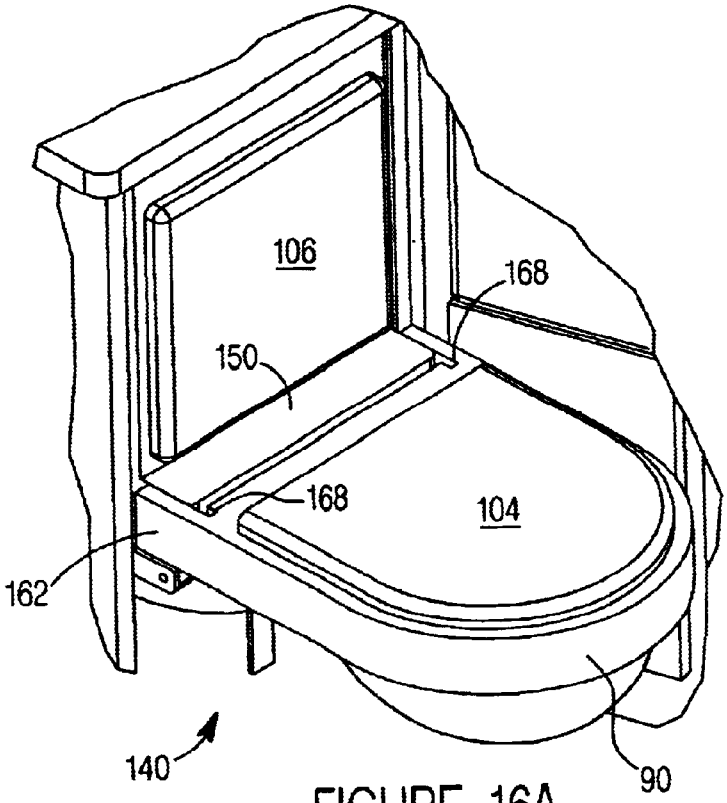
FIGS. 16A through 16C are front fragmentary perspective views of the lavatory system of FIG. 14.
Figure 16B:
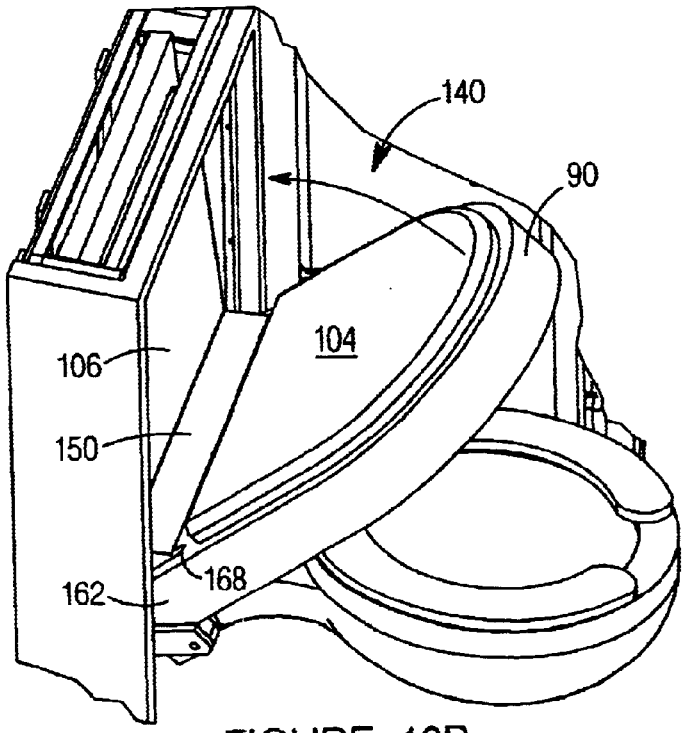
Figure 16C:
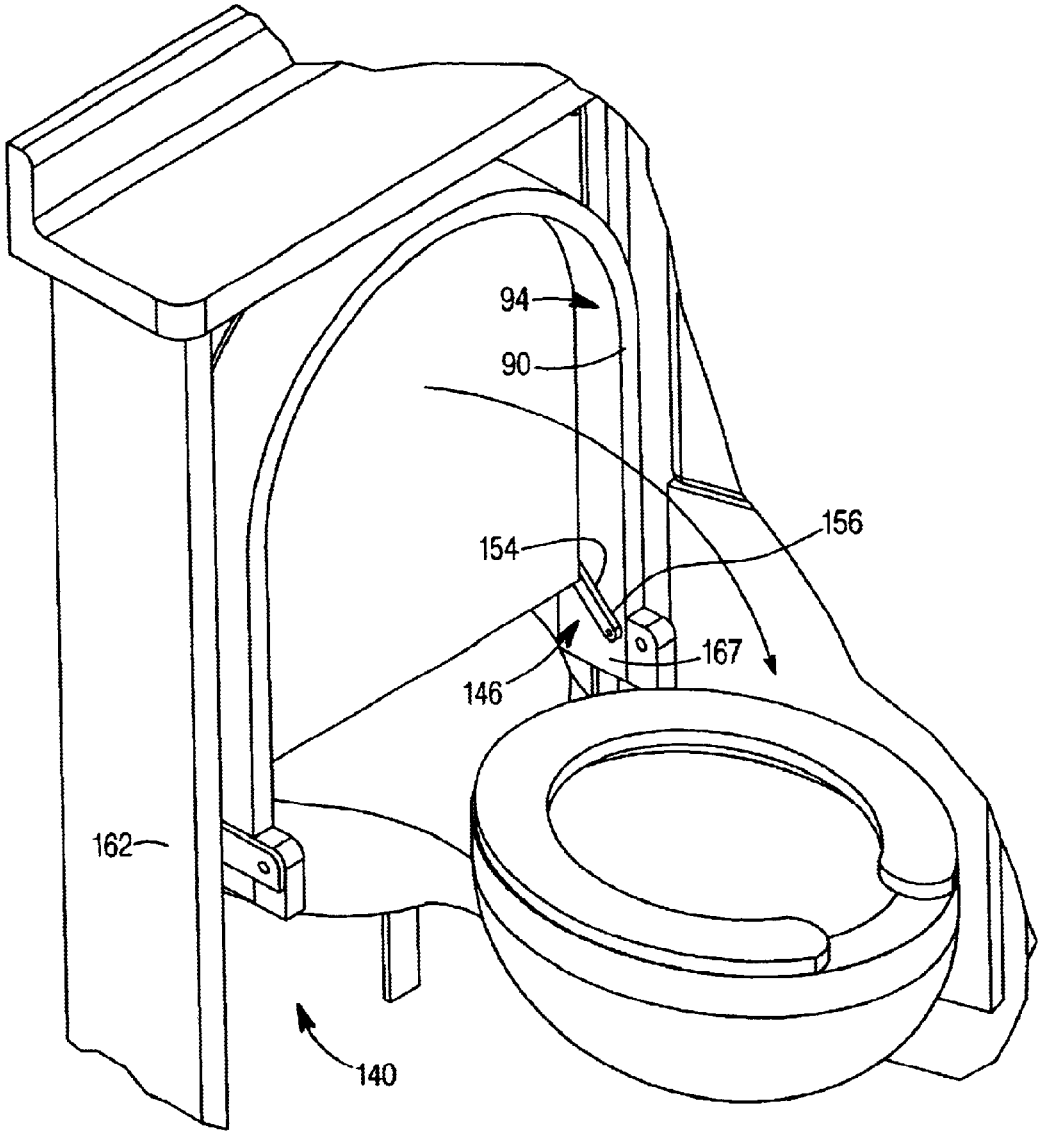

According to a preferred embodiment shown in FIGS. 8A, 8B, and 13, a follower assembly 135 includes a rod 137 that is supported by and slides along a pair of guides (e.g., cam, track, bracket, arm, etc., shown as rods 133) mounted on frame 26. Rod 137 is attached to back surface 126 of backrest 82 with brackets 141. Rods 133 are supported by vertical frame members 30. Rods 133 are intended to provide a sliding bearing surface with a reduced amount of friction (due to the curved shape of rods 133 that engages rod 137) when cover 80 is activated between a use position and a stowed position. Rods 133 are sloped generally downward so that backrest 82 moves downward relative to countertop 18 when moving to the retracted position. By lowering backrest 82, it is intended to allow gravity to assist movement of backrest 82 when being moved to the stowed position.

According to an alternative embodiment shown in FIGS. 8A, 8B, 9A, and 9B, follower assembly 135 includes a pair of guides (shown as brackets 139) mounted on frame 26. Brackets 139 include a slot 143 that is configured to receive rod 137 and provide a sliding bearing surface for when cover 80 is activated between a use position and a stowed position. According to preferred embodiment, slot 143 is sloped generally downward so that backrest 82 moves downward relative to countertop 18 when moving to the retracted position.

According to an alternative embodiment shown in FIGS. 3, 6, 10, and 11, each follower assembly 86 includes a latch (e.g., a spring loaded latch assembly 130) that slidably couples to brackets 132 of frame 26. Latch assembly 130 includes a retractable pin 134 that engages a slot (e.g., rail or track 136) in bracket 132. A base 138 of latch assembly 130 may be mounted to back surface 126 of backrest 82 using any of a variety of techniques (e.g., fasteners, rivets, etc.). Pin 134 of latch assembly 130 is configured to be retracted into base 138 by actuation of a knob 139 so that backrest 82 may be pivoted generally outward to gain access to the interior of cabinet assembly 12 or to plumbing 14.

Referring to the FIGURES, a pad 100 may be provided on cover 80 and/or backrest 82. According to a preferred embodiment, pads 100 are connected by a web 102. Web 102 is intended to at least partially obscure or cover the gap between cover 80 and backrest 82 (e.g., for aesthetic or appearance reasons, to prevent things (such as objects, fluids, and the like) from failing in toilet 20, etc.) and/or to catch or deflect water, fluids or other spillage and contamination, and to protect the mechanism from the same. Web 102 may be made of any of a variety of materials that are attached to ends of pads 100 (e.g., sewn, stapled, fastened, etc.). According to a preferred embodiment, web 102 is made from a non-absorbent material that is cleanable and flexible (e.g., vinyl, nylon, plastic, elastomer, etc.). According to a particularly preferred embodiment, the pads are made from foam or sponge and includes a vinyl cover. According to an alternative embodiment, a single separate pad may be attached to both cover 80 and backrest 82. According to another alternative embodiment shown in FIGS. 14–18B, the cover and backrest have separate pads 104, 106, respectfully. According to an exemplary embodiment pads 100 or pads 104, 106 are attached to cover 80 by a permanent fastener such as a screen, bolt, staple, pin, etc. According to an alternative embodiment, pads 100 or pads 104, 106 are coupled to cover 80 and backrest 82 by a fastener 108 so that pads 100, or pads 104, 106, are quickly and easily removable from cover 80 and/or backrest 82. Fastener 108 may be any of a variety of attachment devices such as latch-hook fasteners (e.g., Velcro™), snaps, buttons, quick release devices, or the like. By being quickly and easily removable, it is intended to provide fast and easy clean up and to prevent further spread of fluids or contamination. According to another alternative embodiment, pads are not connected but have a web that is separately coupled to cover 80 or backrest 82. According to another alternative embodiment, the web is not attached to either of the pads, but is made from a rigid or flexible material (e.g., metal, plastic, etc.) that is coupled to the backrest, cover, brackets, and/or mechanism.

Referring to FIGS. 14–18B, a cover assembly 140 according to an alternative embodiment is shown. Cover assembly 140 includes a cover 142 pivotally coupled to a backrest 144 by a mechanism 146. Cover 142 is coupled to frame 26 by brackets 148 and coupled to backrest 144 by mechanism 146. Backrest 144 includes a backrest member 150 (foot, fin, plate, etc.) that extends generally perpendicular from backrest 144 and between slots 152. Backrest member 150 is generally configured to fill in the void or space between backrest 144 and cover 142.

Figure 17A:
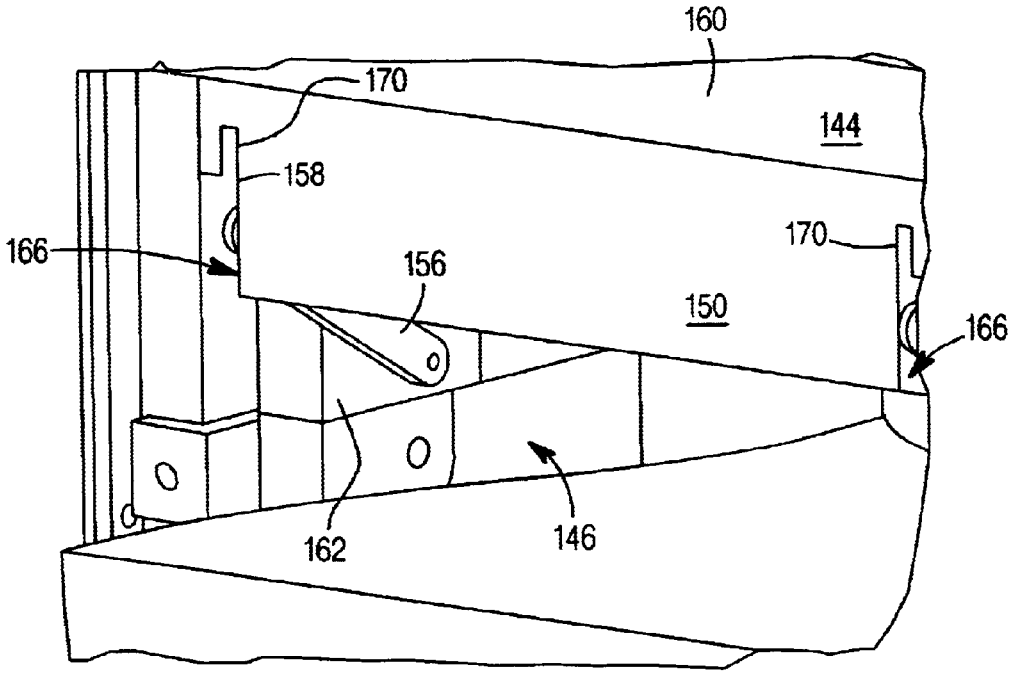
FIGS. 17A through 17C are rear fragmentary perspective views of the lavatory system of FIG. 14.
Figure 17B:
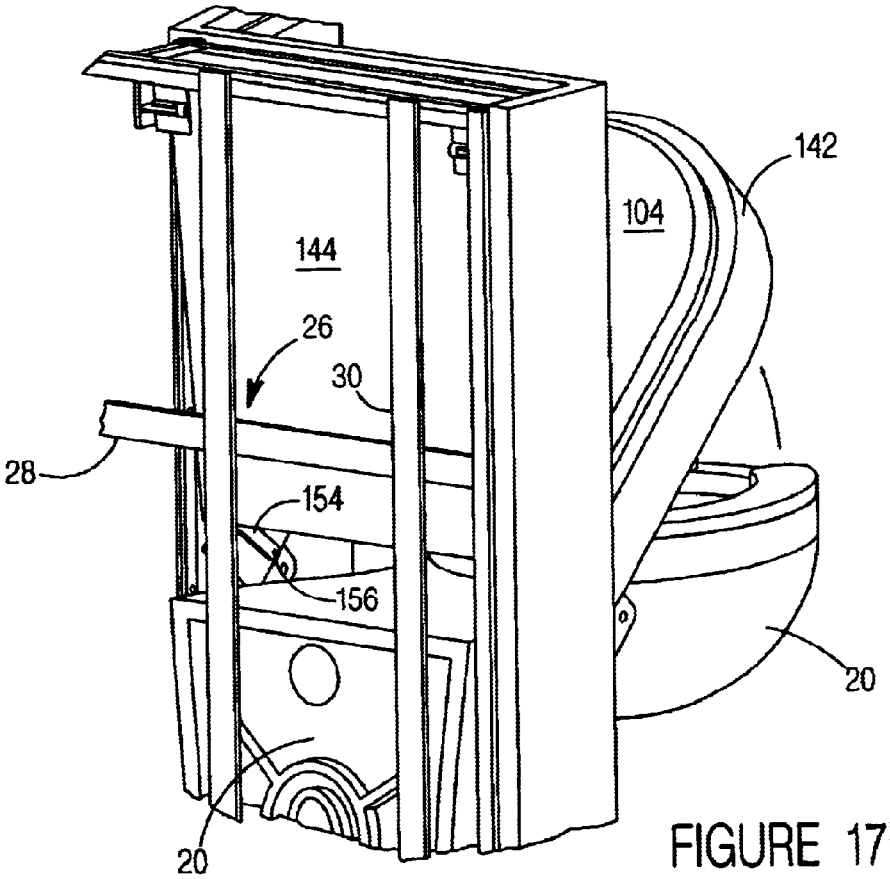
Figure 17C:
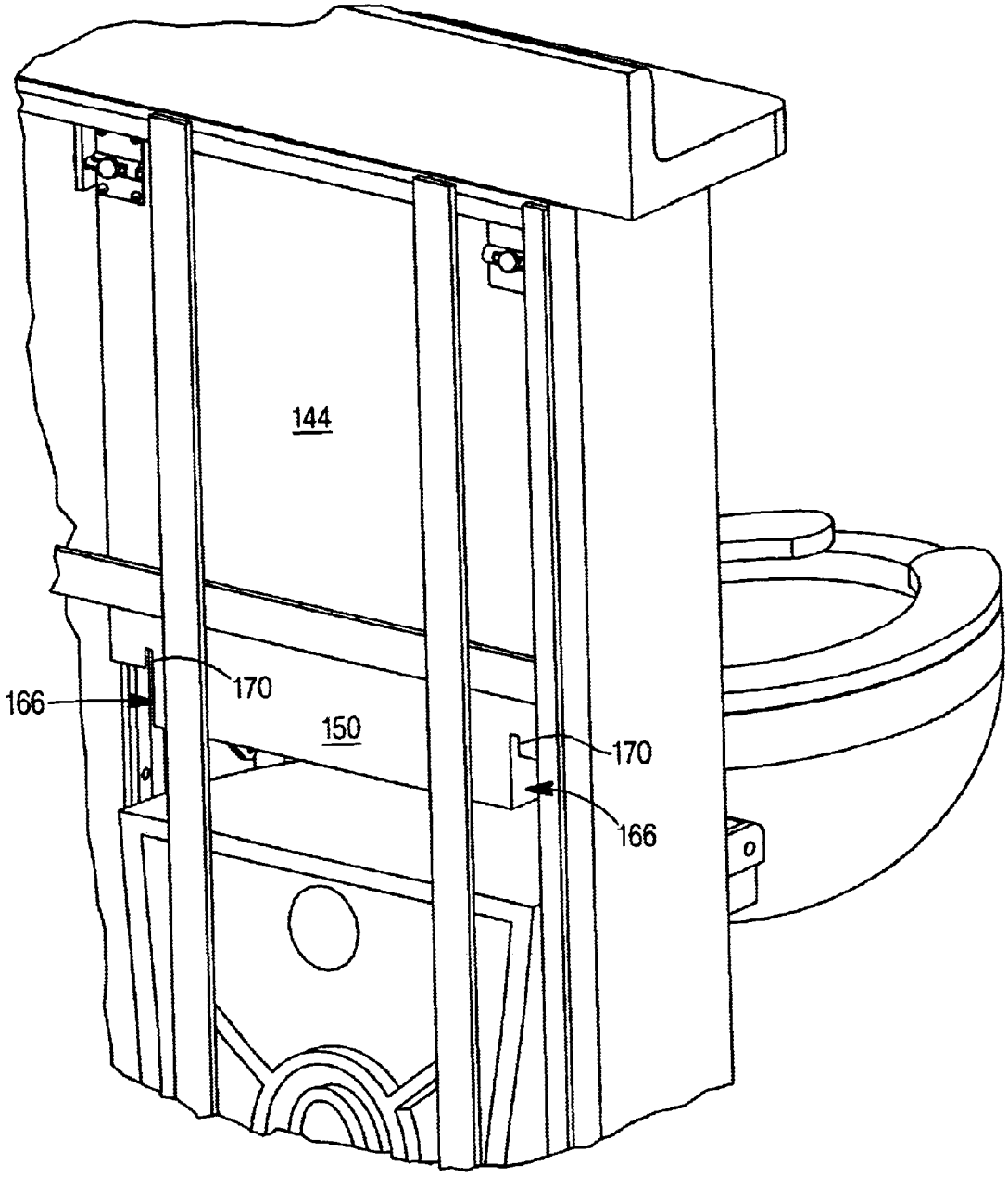
Figure 18A:
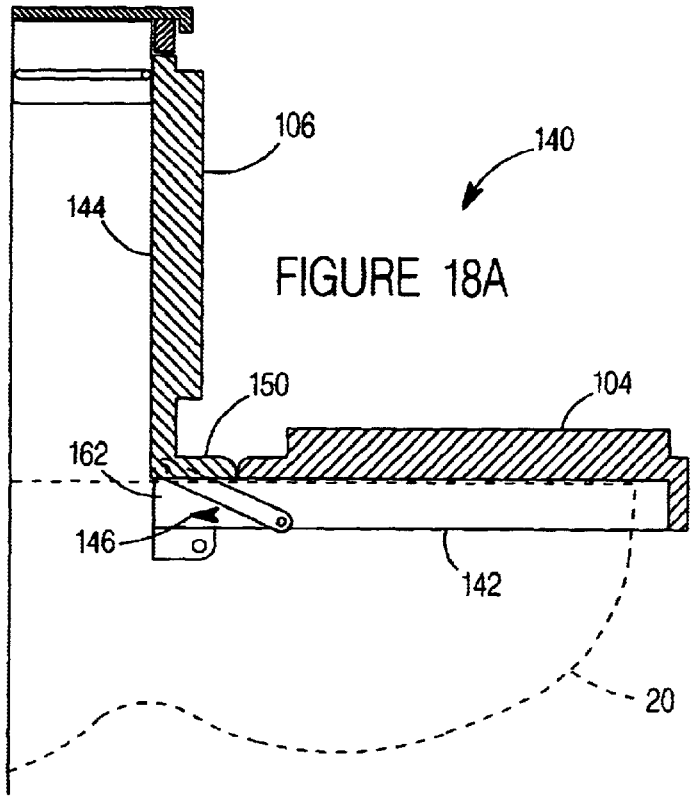
FIG. 18A is a sectional view of the lavatory system of FIG. 14.
Figure 18B:
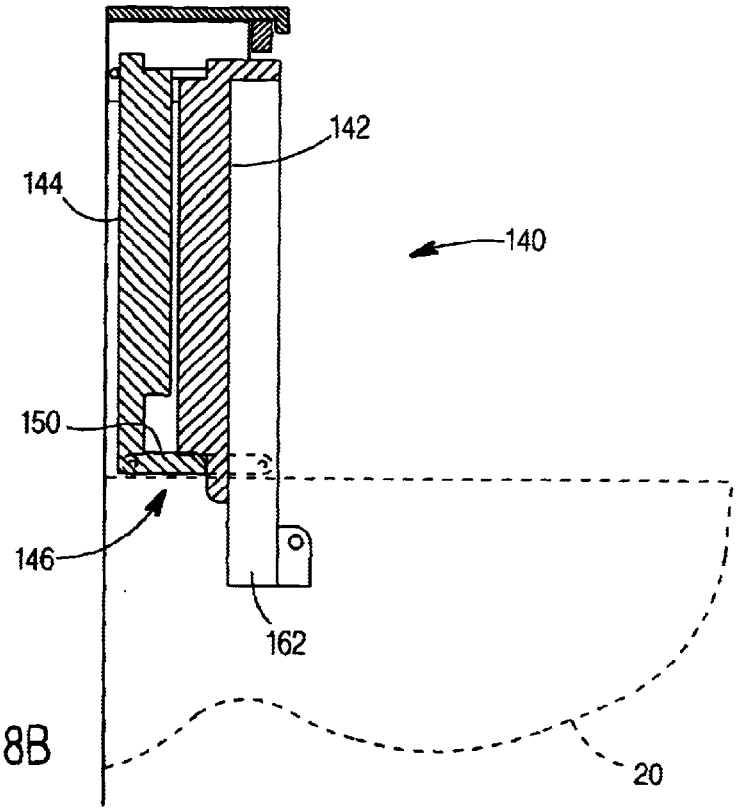
FIG. 18B is a sectional view of the lavatory system of FIG. 14.

Mechanism 146 includes a pair of members 154 coupled at one end 156 to cover 142 and coupled at another end 158 to backrest 144 (see FIG. 17A). According to a preferred embodiment, edges of backrest 144 approximately align with edges of cover 142. As such, end 156 of member 154 couples to inner surface 94 of apron 90 away from end 162 of cover 142. End 158 of member 154 couples to a surface 166 that is inset from the outer edge of backrest 144 and that projects below end 160 of backrest 144 (e.g., intended to provide for simplified assembly).

Figure 19:
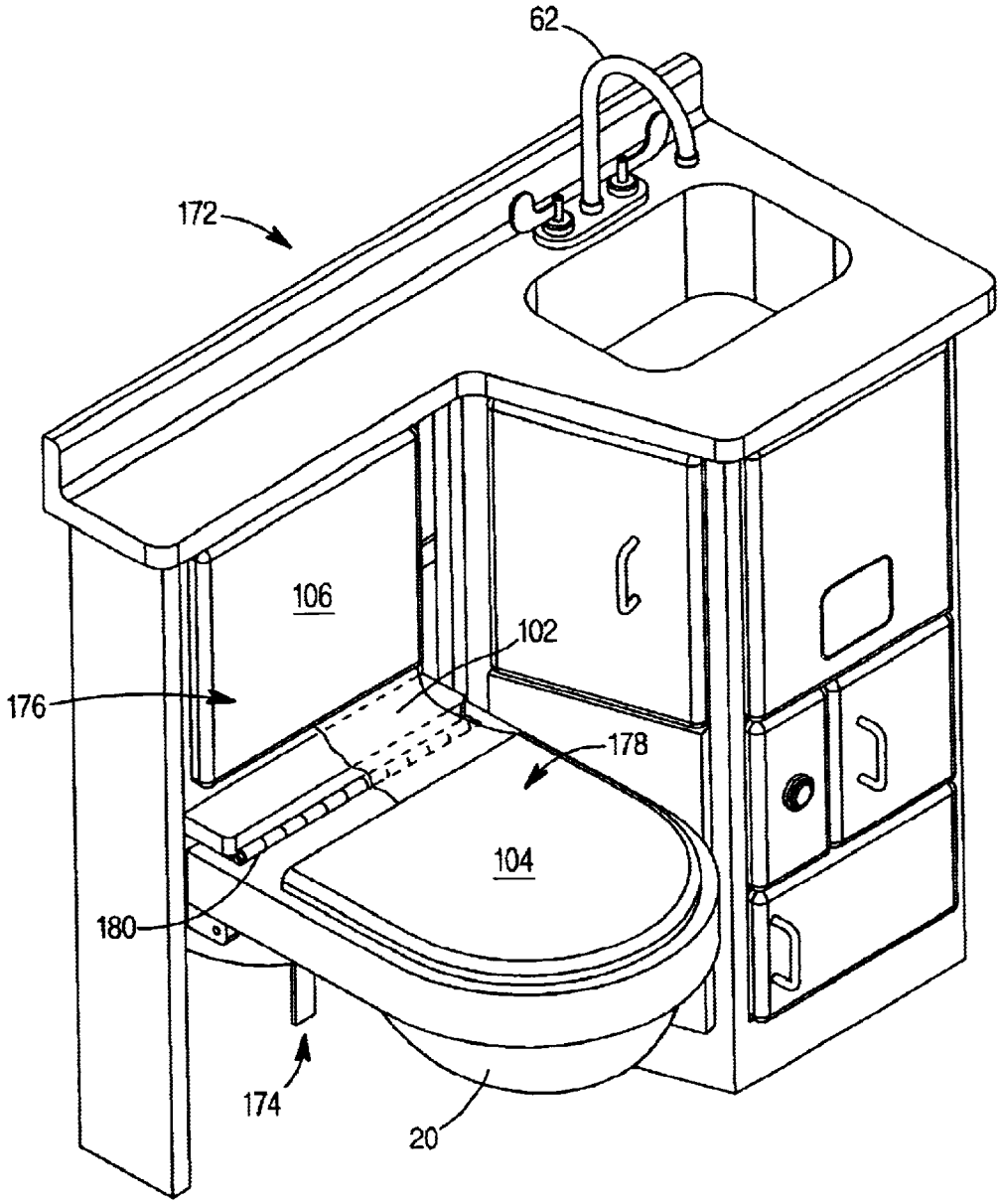
FIG. 19 is a perspective view of a lavatory system showing a toilet having a cover in a down or closed position over a toilet according to a preferred embodiment.
Figure 20:
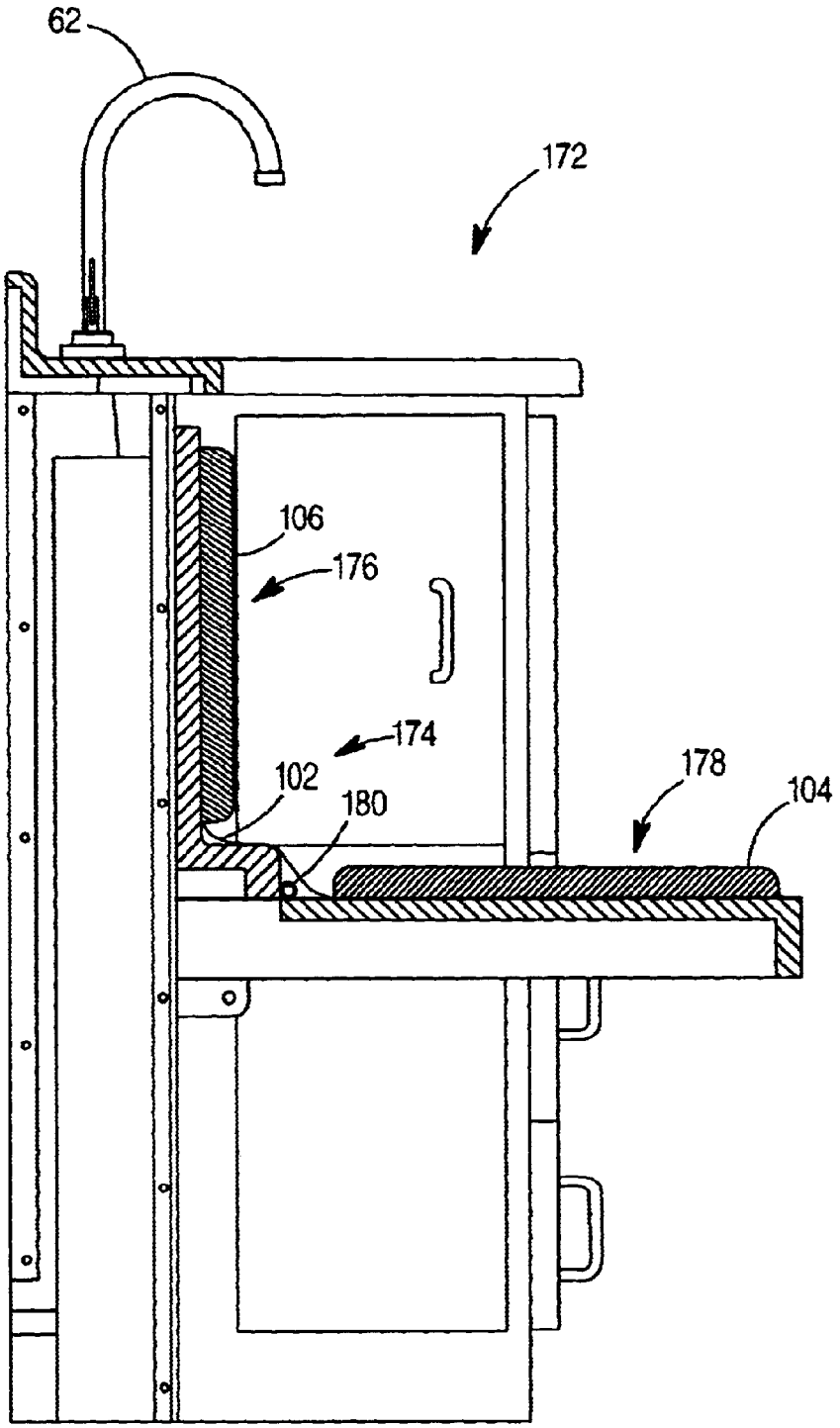
FIG. 20 is a sectional view of the lavatory system of FIG. 19.
Figure 21:
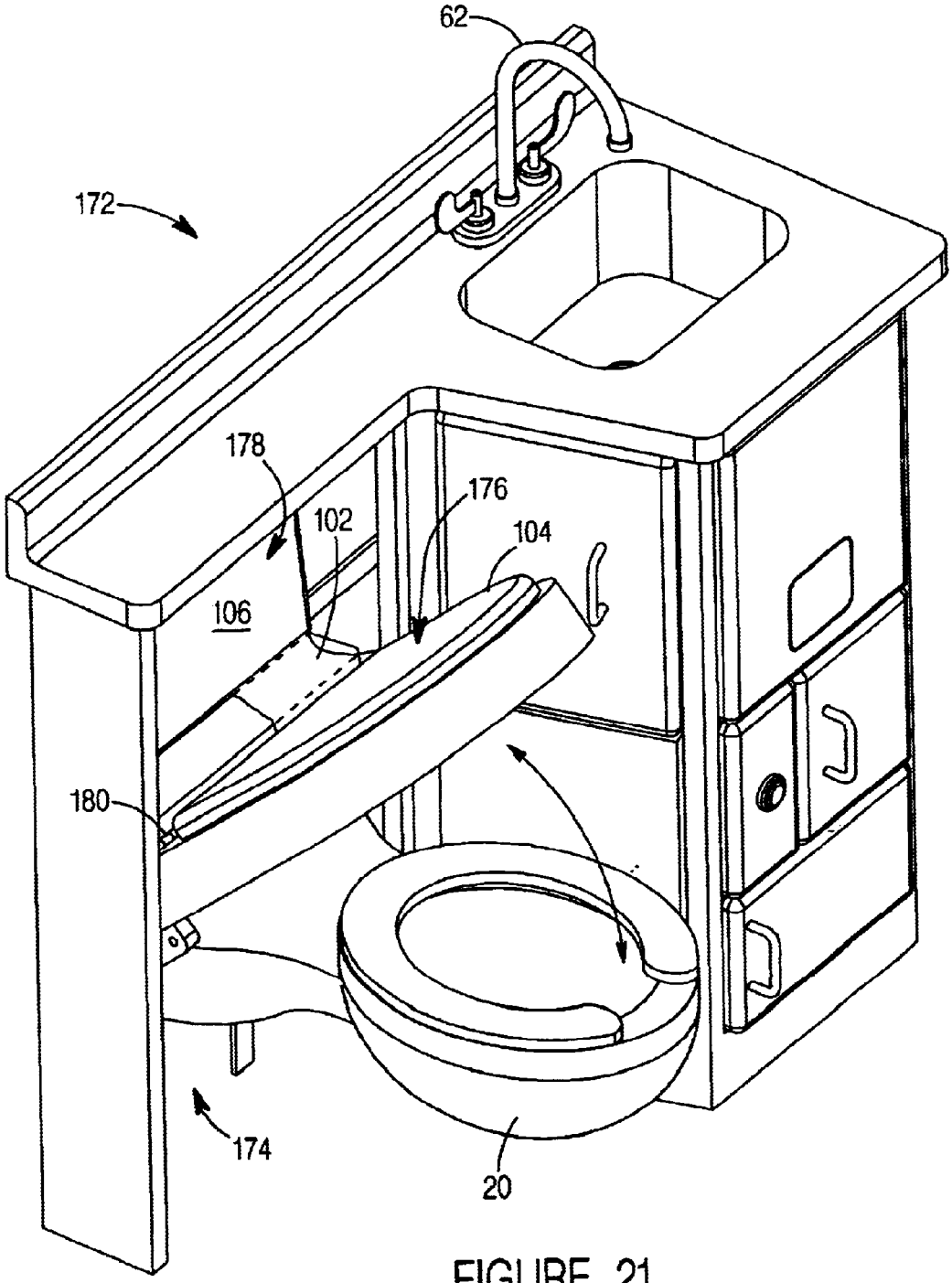
FIG. 21 is a perspective view of the lavatory system of FIG. 20 showing the cover in the partially open position.
Figure 22:
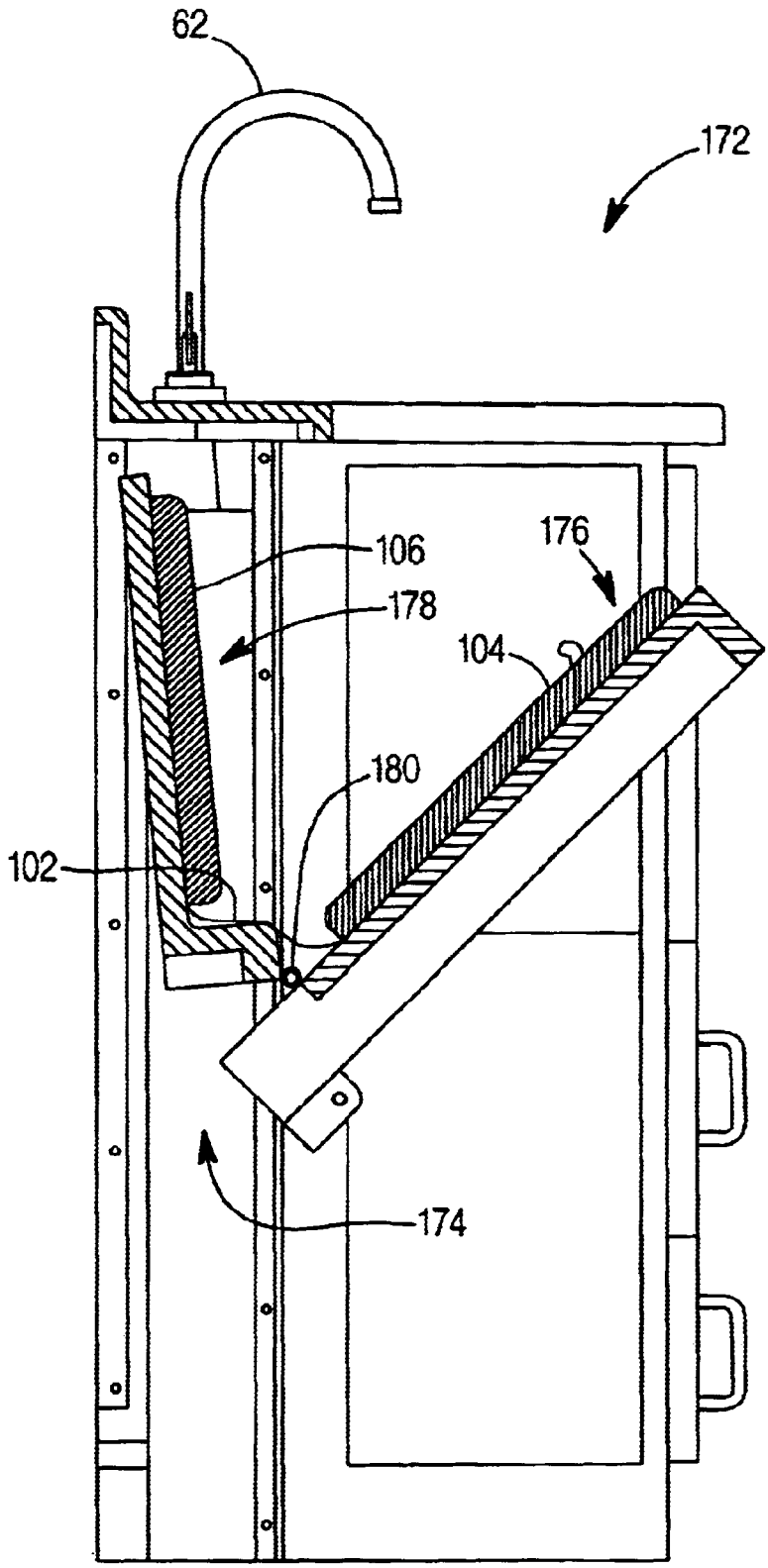
FIG. 22 is the sectional view of the lavatory system in FIG. 21.
Figure 23:
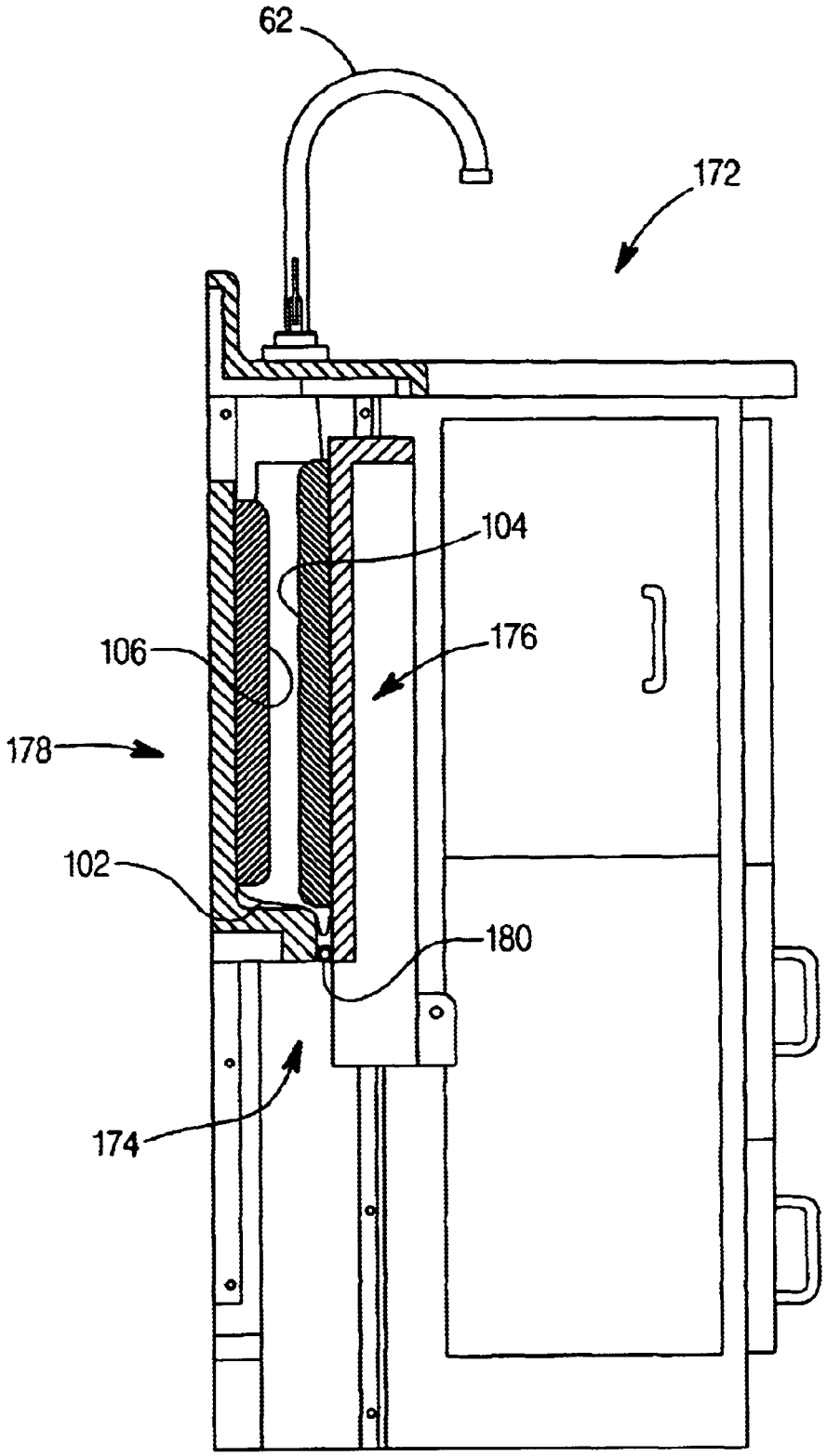
FIG. 23 is the sectional view of the lavatory system in FIG. 19 with the cover in the stowed position.

During operation, as cover 142 is rotated towards a generally vertical position, members 154 of mechanism 146 rotate about ends 156, 158 to actuate backrest 144 towards its retracted or stowed position. Slots 168, 170 are provided in cover 142 and backrest 144, respectfully, to provide a desired range of motion for members 154. According to a particularly preferred embodiment, members are approximately 4.5 to 5.5 inches between pivot points, and is disposed at approximately a 24° to 30° angle (from horizontal). According to a particularly preferred embodiment, members are approximately 4.8 to 5.2 inches between pivot points, and is disposed at approximately a 25° to 29° angle (from horizontal). When cover 142 is in the generally vertical position, members are configured to be in a generally horizontal position (see FIG. 19B). According to alternative embodiments, when configurations and dimensions of backrest, cover, pads, etc. are changed, positioning, configuration, and size of members may be changed accordingly.

Referring to FIGS. 19–23, a lavatory system 172 according to an alternative embodiment is shown. Lavatory system 172 includes a cover assembly 174 having a backrest 176, a cover 178 coupled to backrest 176 by a hinge 180. According to a preferred embodiment, hinge 180 is at least partially covered to protect it from contamination. According to an exemplary embodiment, hinge 180 may be at least partially covered by a single pad 100 or a pair of pads coupled by a barrier 182 are attached to cover 178 and backrest 176. According to an alternative embodiment, barrier 182 may be separately or individually provided to partially cover the hinge 180, but not attached to the pads. The barrier may be rigid, semi-rigid, flexible, plastic, cloth, metal, a web, movable with cover and/or backrest, removable and/or replaceable (e.g., if becomes wet, soiled or the like), etc. Cover 178 is coupled to frame 26 by a pair of brackets 184. According to a preferred embodiment, brackets 184 are mounted directly to frame 26, which is intended to provide stability and strength for supporting cover 178 when used or when being pivoted.

According to a preferred embodiment, the lavatory system has a "footprint" of approximately 30 to 50 inches wide and 20 to 32 inches depth, and an overall height of approximately 35 to 43. According to a particularly preferred embodiment, the lavatory system has a "footprint" of approximately 38 to 42 inches wide and 25 to 28 inches depth, and an overall height of approximately 38 to 41.

According to an exemplary embodiment, the position of the cover, panel, and/or mechanisms may be adjusted for convenience or ease of movement (e.g., by adjustment of mechanisms, the frame, etc.)

According to a particularly preferred embodiment, panels 24 are made of ¾ inch plywood and include a decorative high pressure laminate finish and are attached to frame 26 with fasteners.

According to a particularly preferred embodiment, the frame is made from type 304, 14-gauge stainless steel that is connected by TIG welding. According to alternative embodiments, the support members may have any of a variety of configurations and be made from any of a variety of materials.

The toilet may be any conventional type (e.g., may provide a seat and a lid) and adapted for floor mounting, wall mounting, etc. According to a preferred embodiment, the toilet is an elongated, china wall mounted unit with rear drain, and rear spud design with a blowout jet-type with an integral flushing rim and a remote activated hydraulic flushing system with push button activator. According to a particularly preferred embodiment, the toilet is a 3H449E Placidus commercially available from Crane Plumbing of Evanston, Ill. According to an alternative embodiment, the toilet may be any of a variety of toilets or toilets (e.g., mounted to the floor or the like). As shown in the FIGURES, the toilet is positioned on the left when facing the lavatory system. According to alternative embodiments, the toilet may be positioned at any of a variety of positions on the lavatory system (e.g., on the right side etc.).

According to a particularly preferred embodiment, the basin is made from 14 gauge type 304 stainless steel installed in the countertop and caulked with a sealant. According to an alternative embodiment, the countertop and basin are made from solid surface material (e.g., Terreon™) and may be molded separately or integrally molded with the basin.

According to a particularly preferred embodiment, the flush valve is a HY-97A-LC Hydraulic Flush Valve commercially available from Sloan Valve Company of Franklin Park, Ill. According to an alternative embodiment, the flush valve may be any of a variety of flush valves.

According to a particularly preferred embodiment, the faucet is a 895-317-GN2-FC commercially available from Chicago Faucet of Des Plaines, Ill. According to an alternative embodiment, the faucet may be any of a variety of faucets or faucet assemblies.

According to a particularly preferred embodiment, the bed pan washer is a BPW-1000 Slimline Bedpan Washer commercially available from Sloan Valve Company of Franklin Park, Ill.

It is also important to note that the construction and arrangement of the elements of the lavatory system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, the mechanism may have any of a variety of dimensional and positions depending on the configuration of the cover and/or backrest. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. An apparatus for installation in a lavatory having a toilet with a bowl, the apparatus comprising:

a base;

a backrest coupled to the base;

a cover coupled to the backrest and movable between a first position and a second position;

a first mechanism including a linkage coupled to the backrest and the cover;

wherein access to the bowl of the toilet is at least partially obstructed by movement of the cover.

2. The apparatus of claim 1 wherein the linkage comprises a member.

3. The apparatus of claim 1 wherein the linkage comprises a plurality of members.

4. The apparatus of claim 1 wherein the linkage comprises a link.

5. The apparatus of claim 1 wherein the linkage includes a first end coupled to an exterior side of cover.

6. The apparatus of claim 5 wherein the linkage includes a second end coupled to the base.

7. The apparatus of claim 6 wherein the second end of the linkage is directly coupled to the backrest.

8. The apparatus of claim 1 wherein the first mechanism further comprises a bracket mounted to the backrest and configured to interface with the cover.

9. The apparatus of claim 8 wherein the bracket is configured to limit a range of motion of the backrest when a force is applied to the panel.

10. The apparatus of claim 8 wherein the bracket is configured to limit a path of travel of the backrest when a force is applied to the panel.

11. The apparatus of claim 1 further comprising a second mechanism.

12. The apparatus of claim 11 wherein the second mechanism couples the backrest to the base.

13. The apparatus of claim 11 wherein the second mechanism comprises a guide.

14. The apparatus of claim 13 wherein the second mechanism further comprises a member configured to engage the guide.

15. The apparatus of claim 14 wherein the member is a first rod.

16. The apparatus of claim 15 wherein the guide is a second rod.

17. The apparatus of claim 11 wherein the second mechanism comprises a pair of guides.

18. The apparatus of claim 11 wherein the second mechanism comprises a follower.

19. The apparatus of claim 11 wherein the second mechanism comprises a follower assembly.

20. The apparatus of claim 11 wherein the second mechanism comprises a member coupled to the backrest.

21. The apparatus of claim 20 wherein the second mechanism further comprises a bracket configured to engage the member.

22. The apparatus of claim 21 wherein the bracket comprises a slot configured to receive the member.

23. The apparatus of claim 11 wherein the second mechanism comprises a cam.

24. The apparatus of claim 11 wherein the second mechanism comprises a track.

25. The apparatus of claim 1 wherein the first position is a fully stowed position.

26. The apparatus of claim 1 wherein the second position is a fully deployed position.

27. The apparatus of claim 1 wherein the cover pivots between the first position and the second position.

28. The apparatus of claim 1 wherein the cover translates between the first position and the second position.

29. The apparatus of claim 1 wherein access is visual access.

30. The apparatus of claim 1 wherein access is physical access.

31. The apparatus of claim 1 further comprising a basin.

32. The apparatus of claim 1 further comprising a plumbing system.

33. The apparatus of claim 1 wherein the base comprises a cabinet.

34. The apparatus of claim 1 wherein the base comprises a frame.

35. The apparatus of claim 1 wherein the base comprises a mounting fixture.

36. The apparatus of claim 1 wherein the cover is a seat.

37. A lavatory system comprising:

a base;

a panel coupled to the base;

a cover movable relative to the base between a first position and a second position;

a mechanism coupled to the cover and the panel, the mechanism comprising at least one member having a first end and a second end, the first end being coupled to the panel and the second end being coupled to the cover;

wherein movement of the cover from a use position towards a stowed position actuates the at least one member to move the panel from an extended position towards a retracted position.

38. The lavatory system of claim 37 wherein the use position of that cover is generally horizontal.

39. The lavatory system of claim 37 wherein the stowed position of the cover is generally vertical and disposed within the base.

40. The lavatory system of claim 37 wherein the panel in the extended position is generally flush with the front of the base.

41. The lavatory system of claim 37 wherein the retracted position of the panel provides for the panel to be generally disposed within the base.

42. The lavatory system of claim 37 wherein the mechanism includes a pair of members.

43. The lavatory system of claim 37 further including a second mechanism configured to couple the panel to the base.

44. The lavatory system of claim 43 wherein the second mechanism comprises a first member coupled to the base and a second member coupled to the panel, the second member having ends that are configured to move relative to the first member.

45. The lavatory system of claim 43 wherein the second mechanism includes a bracket coupled to the base and a latch mounted to the panel.

46. The lavatory system of claim 45 wherein the latch assembly includes a pin configured to slide along a slot in the bracket when the panel is moved between the extended position and the retracted position.

47. The lavatory system of claim 46 wherein the pin is retractable from the slot.

48. The lavatory system of claim 45 wherein the latch assembly includes a rod that engages a slot in the bracket.

49. The lavatory system of claim 48 wherein the slot is sloped generally downward nearest the panel.

50. The lavatory system of claim 37 further including a first pad coupled to the panel, a second pad coupled to the cover, and a web coupled to the first and second pads.

51. The lavatory system of claim 50 wherein the web couples the first pad to the second pad.

52. The lavatory system of claim 50 wherein the web couples the first pad to the panel or the second pad to the cover.

53. The lavatory system of claim 50 wherein the pad is quickly and easily remove from one of the panel and cover.

54. The lavatory system of claim 53 wherein the pad is attached to one of the panel and the cover.

55. The lavatory system of claim 50 wherein the web is made of a flexible material.

56. The lavatory system of claim 50 wherein the web is made of a rigid material.

57. A lavatory system comprising:

a base;

a panel coupled to the base;

a cover movable relative to the base between a first position and a second position;

a first mechanism coupled to the cover and the panel, the mechanism comprising at least one member having a first end and a second end, the first end being coupled to the panel and the second end being coupled to the cover;

a second mechanism configured to couple the panel to the base;

wherein movement of the cover from a use position towards a stowed position actuates the at least one member to move the panel from an extended position towards a retracted position;

wherein the second mechanism comprises a first member coupled to the base and a second member coupled to the panel, the second member having ends that are configured to move relative to the first member;

wherein the second member slides along the first member.

58. An apparatus for installation in a lavatory having a toilet with a bowl, the apparatus comprising:

a base;

a panel coupled to the base and movable between a deployed position and a stowed position;

a cover coupled to the panel and movable between a deployed position and a stowed position;

a first mechanism including a linkage coupled to the panel and the cover;

wherein access to the bowl of the toilet is at least partially obstructed by movement of the cover;

wherein the first mechanism is configured to transfer movement of the cover between the deployed and stowed position to movement of the panel between the deployed and stowed positions.

59. The apparatus of claim 58 wherein the movement of the panel comprises pivoting and translating movement.

60. The apparatus of claim 59 wherein the movement of the cover comprises pivoting movement.

61. The apparatus of claim 60 wherein the linkage comprises a link member having a first end coupled to the cover and a second end coupled to the panel.

62. The apparatus of claim 58 further comprising a second mechanism configured to couple the panel to the base, wherein the second mechanism comprises a first member coupled to the base and a second member coupled to the panel and configured to slide along the first member.

* * * * *